US008284106B2

(12) United States Patent
Guan

(10) Patent No.: US 8,284,106 B2
(45) Date of Patent: Oct. 9, 2012

(54) ANTENNA AND WIRELESS COMMUNICATION DEVICE

(75) Inventor: Ning Guan, Chiba (JP)

(73) Assignee: Fujikura Ltd., Tokyo (JP)

( * ) Notice: Subject to any disclaimer, the term of this patent is extended or adjusted under 35 U.S.C. 154(b) by 226 days.

(21) Appl. No.: 12/812,680

(22) PCT Filed: Jan. 21, 2009

(86) PCT No.: PCT/JP2009/050816

§ 371 (c)(1),
(2), (4) Date: Jul. 13, 2010

(87) PCT Pub. No.: WO2009/093591

PCT Pub. Date: Jul. 30, 2009

(65) Prior Publication Data

US 2010/0289709 A1 Nov. 18, 2010

(30) Foreign Application Priority Data

Jan. 21, 2008 (JP) ..... 2008-010471

(51) Int. Cl.
*H01Q 1/38* (2006.01)
*H01Q 1/36* (2006.01)

(52) U.S. Cl. ..... 343/700 MS; 343/895; 343/702

(58) Field of Classification Search ..... None
See application file for complete search history.

(56) References Cited

U.S. PATENT DOCUMENTS 6,147,652 A 11/2000 Sekine
6,930,641 B2 8/2005 Ohara et al.
7,733,271 B2 * 6/2010 Moon et al. ..... 343/700 MS
2005/0104783 A1 5/2005 Kojima
2005/0259031 A1 * 11/2005 Sanz et al. ..... 343/895
2006/0038722 A1 * 2/2006 Tseng et al. ..... 343/700 MS
2006/0170610 A1 * 8/2006 Rabinovich et al. ..... 343/895
2007/0103371 A1 * 5/2007 Kim et al. ..... 343/702
2007/0103374 A1 * 5/2007 Lindackers et al. ..... 343/713

(Continued)

FOREIGN PATENT DOCUMENTS

JP 11-154815 A 6/1999

(Continued)

OTHER PUBLICATIONS

Wu, Chih-Hsien et al.; "Low-Profile Printed Monople Antenna for Penta-Band Operation in the Mobile Phone," IEEE AP-S Int. Symp., pp. 3540-3543, 2007.

Lin, Chun I. et al.; "Printed Monopole Slot Antenna for Multiband Operation in the Mobile Phone"; IEEE AP-S Int. Symp., pp. 629-632, 2007.

(Continued)

*Primary Examiner* — Trinh Dinh
(74) *Attorney, Agent, or Firm* — Westerman, Hattori, Daniels & Adrian, LLP

(57) ABSTRACT

An antenna that is small in size, has such input characteristics as to secure consistency in each band, and is capable of maintaining omnidirectionality. An antenna includes a grounded conductor, a shorting pin that is formed with a conductor, and a radiation conductor that has one end connected to the grounded conductor via the shorting pin, has the other end left open, and receives power supplied from a feeding point located at the one end. The radiation conductor is folded at a portion between the one end and the other end, and forms a lower arm closer to the grounded conductor and a folded upper arm, with at least part of the lower arm and the upper arm having a meandered portion.

7 Claims, 17 Drawing Sheets

U.S. PATENT DOCUMENTS

| | | | | |
|---|---|---|---|---|
| 2009/0079643 | A1 * | 3/2009 | Lin et al. | 343/745 |
| 2010/0214174 | A1 * | 8/2010 | Guan et al. | 343/700 MS |

FOREIGN PATENT DOCUMENTS

| | | | |
|---|---|---|---|
| JP | 2004-032242 | A | 1/2004 |
| JP | 2006-510321 | A | 3/2006 |
| JP | 2006-197528 | A | 7/2006 |
| JP | 2007-028255 | A | 2/2007 |

OTHER PUBLICATIONS

Deng, Heng et al.; "A Triple-Band Compact Monopole Antenna for Mobile Handsets"; IEEE AP-S Int. Symp., pp. 2069-2072, 2007.

Tung, Hao-Chun et al.; "Shorted Monopole Antenna for Curved Shape Phone Housing in Clamshell Phone," IEEE AP-S Int, Symp., pp. 1060-1063, 2007.

Lee, Hyun-Jeong et al.; "The compact quad-band planar internal antenna for mobile handsets"; IEEE AP-S Int. Symp., pp. 2045-2048, 2007.

Tang, I-Tseng et al.; "Compact Five-Band Meandered PIFA by Using Meandered Slots Structure"; IEEE AP-S Int,. Symp., pp. 653-656, 2007.

Yoon, Seunghwan et al.; "Triple-band Fractal Antenna Design for Handset System"; IEEE AP-S Int. Symp., pp. 813-816, 2007.

Notification of Transmittal of Translation of the International Preliminary Report on Patentability (Form PCT/IB/338) of International Application No. PCT/JP2009/050816 mailed Sep. 10, 2010 with Forms PCT/IB/373 and PCT/ISA/237.

International Search Report of PCT/JP2009/050816, Mailing Date of May 12, 2009.

* cited by examiner 12
13
11
107
5mm
Z
Y
X

S11 [dB]
0
-5
-10
-15
-20
0.00
0.50
1.00
1.50
2.00
2.50
FREQUENCY [GHz]

Y
90
120
150
180
210
240
270
-Y
-X
X
300
330
0
30
60
φ [deg]
128a
128b
10[dBi]
0
-10
-20
-30

128c
128d

ANTENNA AND WIRELESS COMMUNICATION DEVICE

RELATED APPLICATIONS

This application is a 371 of PCT/JP2009/050816 filed Jan. 21, 2009, which claims priority under 35 U.S.C. 119 from JAPAN Patent Application No. 2008-010471 filed on Jan. 21, 2008, the contents of which are incorporated herein by references.

TECHNICAL FIELD

The present invention relates to an antenna that is used in a wireless communication device such as a mobile phone handset that transmits and receives radio signals. More particularly, the present invention relates to an antenna that operates in frequency multibands such as the GSM band of 880 MHz to 960 MHz, the DCS band of 1710 MHz to 1880 MHz, the PCS band of 1850 MHz to 1990 MHz, and the UMTS band of 1920 MHz to 2170 MHz.

BACKGROUND ART

Various kinds of antennas that can cope with multibands that are used in a mobile phone handset have been suggested. Examples of such antennas include antennas each having meandered slots formed on a meandered patch (see Non-Patent Document 1, for example), monopole slot antennas (see Non-Patent Document 2, for example), antennas each using a plurality of monopoles (see Non-Patent Documents 3, 4, and 5, for example), planar inverted F antennas (PIFA) (see Non-Patent Document 6, for example), and fractal antennas (see Non-Patent Document 7, for example).

Multiband antennas to be used in wireless communication devices must cope with GSM (880 MHz to 960 MHz), DCS (1710 MHz to 1880 MHz), PCS (1850 MHz to 1990 MHz), and UMTS (1920 MHz to 2170 MHz). The second resonance frequency band needs to be a wide band of 1710 MHz to 2170 MHz, with DCS, PCS, and UMTS being combined.

Non-Patent Document 1: I-T. Tang, D-B. Lin, W-L. Chen, J-H. Horng, and C-M. Li, "Compact five-band meandered PIFA by using meandered slots structure", IEEE AP-S Int. Symp., pp. 653-656, 2007

Non-Patent Document 2: C-I. Lin, K-L. Wong, and S-H. Yeh, "Printed monopole slot antenna for multiband operation in the mobile phone", IEEE AP-S Int. Symp., pp. 629-632, 2007

Non-Patent Document 3: C-H. Wu and K-L. Wong, "Low-profile printed monopole antenna for penta-band operation in the mobile phone", IEEE AP-S Int. Symp., pp. 3540-3543, 2007

Non-Patent Document 4: H. Deng and Z. Feng, "A triple-band compact monopole antenna for mobile handsets", IEEE AP-S Int. Symp., pp. 2069-2072, 2007

Non-Patent Document 5: H-C. Tung, T-F. Chen, C-Y. Chang, C-Y. Lin, and T-F. Huang, "Shorted monopole antenna for curved shape phone housing in clamshell phone", IEEE AP-S Int. Symp., pp. 1060-1063, 2007

Non-Patent Document 6: H-J. Lee, S-H. Cho, J-K. Park, Y-H. Cho, J-M. Kim, K-H. Lee, I-Y. Lee, and J-S. Kim, "The compact quad-band planar internal antenna for mobile handsets", IEEE AP-S Int. Symp., pp. 2045-2048, 2007

Non-Patent Document 7 S. Yoon, C. Jung, Y. Kim, and F. D. Flaviis, "Triple-band fractal antenna design for handset system", IEEE AP-S Int. Symp., pp. 813-816, 2007

DISCLOSURE OF THE INVENTION

Problems to be Solved by the Invention

An antenna to be mounted on a wireless communication device is required to be small in size. A multiband antenna is required to have such input characteristics as to secure consistency in each band, and is further required to maintain the highest possible omnidirectionality in each band.

An antenna that has meandered slots formed on a meandered patch (see Non-Patent Document 1, for example) needs a three-dimensional installation space. In such an antenna, the radiation patterns greatly vary with frequency changes, and omnidirectionality cannot be maintained.

In a monopole slot antenna (see Non-Patent Document 2, for example), slots need to be formed on a ground substrate, and therefore, it is necessary to perform processing on the substrate. Also, the radiation patterns depend on frequency, and therefore, omnidirectionality cannot be maintained.

In an antenna using a plurality of monopoles (see Non-Patent Documents 3, 4, and 5, for example), a PIFA (see Non-Patent Document 6, for example), and a fractal antenna (see Non-Patent Document 7, for example), the radiation patterns depend on frequency, and therefore, omnidirectionality cannot be maintained as in a monopole slot antenna.

In view of the above circumstances, the present invention aims to provide an antenna that is small in size, has such input characteristics as to secure consistency in each band, and is capable of maintaining omnidirectionality, and a wireless communication device that has the antenna mounted thereon.

Means to Solve the Problems

The inventor discovered that, if a lower arm or an upper arm is formed by folding an arm-like radiation conductor, and the radiation conductor has meandered portions, the second resonance frequency band including the high-order resonance frequency shifts to the lower frequency side or becomes wider, without a change in the first resonance frequency band including the low-order resonance frequency. The inventor also discovered that omnidirectionality is maintained with such a structure. Here, the meandered portions are protruding portions that protrude in a direction perpendicular to the lower arm, the upper arm, or the shorting pin extending along a straight line that keeps a fixed distance from the grounded conductor. Each of the meandered portions may have a U-like shape, a V-like shape, or an L-like shape that is cut off at a top end.

An antenna according to the present invention includes: a grounded conductor; a shorting pin that is formed with a conductor; and a radiation conductor that has one end connected to the grounded conductor via the shorting pin, has the other end left open, and receives power supplied from a feeding point located at the one end. The radiation conductor is folded at a portion between the one end and the other end, and forms a lower arm closer to the grounded conductor and a folded upper arm, with at least part of the lower arm and the upper arm having a meandered portion.

By forming the folded upper arm and lower arm, the antenna can be made smaller in size. Also, since at least part of the upper arm or the lower arm has a meandered portion, the high-order resonance frequency can shift to the lower frequency side. Thus, the antenna according to the present invention can be small-sized and secure consistency in the input characteristics of each band. Further, omnidirectionality is maintained.

In the antenna according to the present invention, it is preferable that the shorting pin has a meandered portion.

According to this invention, the second resonance frequency band can be made wider.

In the antenna according to the present invention, it is preferable that the radiation conductor and the shorting pin are formed with one continuous conductor line.

This antenna can be easily manufactured.

In the antenna according to the present invention, it is preferable that the radiation conductor is placed in the same plane as the grounded conductor.

According to this invention, the grounded conductor and the radiation conductor can be formed on the same substrate.

In the antenna according to the present invention, it is preferable that the radiation conductor is placed in a different plane from the grounded conductor.

According to this invention, the radiation conductor can be formed on a different substrate from the grounded conductor, without a change in the resonance frequency characteristics. Thus, the antenna can be made smaller in size.

In the antenna according to the present invention, it is preferable that the radiation conductor or the shorting pin is folded at least once along a straight line that runs parallel to the extending direction of the lower arm or the upper arm.

According to this invention, the antenna can be made smaller in size and then mounted on a device, without a change in the resonance frequency characteristics.

In the antenna according to the present invention, it is preferable that the folded radiation conductor is fixed to a dielectric material.

According to this invention, the mounting of the antenna can be made easier, and the total length of the radiation conductor can be reduced.

In the antenna according to the present invention, it is preferable that the radiation conductor is a metal line or a metal film that is formed on a flexible substrate.

With a metal line, the antenna can be easily manufactured. With a metal film, the antenna can be easily manufactured by a printing technique.

A wireless communication device according to the present invention includes the antenna according to the present invention.

This wireless communication device can cover multibands with the small-sized antenna.

Effect of the Invention

According to the present invention, it is possible to provide an antenna that is small in size, has such input characteristics as to secure consistency in each band, and is capable of maintaining omnidirectionality, and a wireless communication device.

BRIEF DESCRIPTION OF THE DRAWINGS

FIG. 2(*a*) shows the structure of the antenna; FIG. 2(*b*) shows the input characteristics of the antenna; and FIG. 2(*c*) and FIG. 2(*d*) show the radiation characteristics in the x-y plane;

FIG. 4(*a*) shows the structure of the antenna; FIG. 4(*b*) shows the input characteristics of the antenna; and FIG. 4(*c*) and FIG. 4(*d*) show the radiation characteristics in the x-y plane;

FIG. 5(*a*) shows the structure of the antenna; FIG. 5(*b*) shows the input characteristics of the antenna; and FIG. 5(*c*) and FIG. 5(*c*) show the radiation characteristics in the x-y plane;

FIG. 6(*a*) shows the structure of the antenna; FIG. 6(*b*) shows the input characteristics of the antenna; and FIG. 6(*c*) and FIG. 6(*d*) show the radiation characteristics in the x-y plane;

FIG. 7(*a*) shows the structure of the antenna; FIG. 7(*b*) shows the input characteristics of the antenna; and FIG. 7(*c*) and FIG. 7(*d*) show the radiation characteristics in the x-y plane;

FIG. 8(*a*) shows the structure of the antenna; FIG. 8(*b*) shows the input characteristics of the antenna; and FIG. 8(*c*) and FIG. 8(*d*) show the radiation characteristics in the x-y plane;

FIG. 9(*a*) shows the structure of the antenna; FIG. 9(*b*) shows the input characteristics of the antenna; and FIG. 9(*c*) and FIG. 9(*d*) show the radiation characteristics in the x-y plane;

FIG. 10(*a*) shows the structure of the antenna; FIG. 10(*b*) shows the input characteristics of the antenna; and FIG. 10(*c*) and FIG. 10(*d*) show the radiation characteristics in the x-y plane;

FIG. 11(*a*) shows the structure of the antenna; FIG. 11(*b*) shows the input characteristics of the antenna; and FIG. 11(*c*) and FIG. 11(*d*) show the radiation characteristics in the x-y plane;

FIG. 12(*a*) shows the structure of the antenna; FIG. 12(*b*) shows the input characteristics of the antenna; and FIG. 12(*c*) and FIG. 12(*d*) show the radiation characteristics in the x-y plane;

FIG. 13(*a*) shows the structure of the antenna; FIG. 13(*b*) shows the input characteristics of the antenna; and FIG. 13(*c*) and FIG. 13(*d*) show the radiation characteristics in the x-y plane;

FIG. 14(*a*) shows an example in which the width of the radiation conductor is smaller; FIG. 14(*b*) shows an example in which the radiation conductor is placed perpendicular to the grounded conductor; FIG. 14(*c*) shows an example in which the radiation conductor is placed in a plane different from the grounded conductor; and FIG. 14(*d*) shows an example in which the bent portion of the radiation conductor is narrower than that of the seventh embodiment;

FIG. 15(*a*) shows an example of a transmission device; and FIG. 15(*b*) shows an example of a reception device;

EXPLANATION OF REFERENCE NUMERALS

Figure 1:
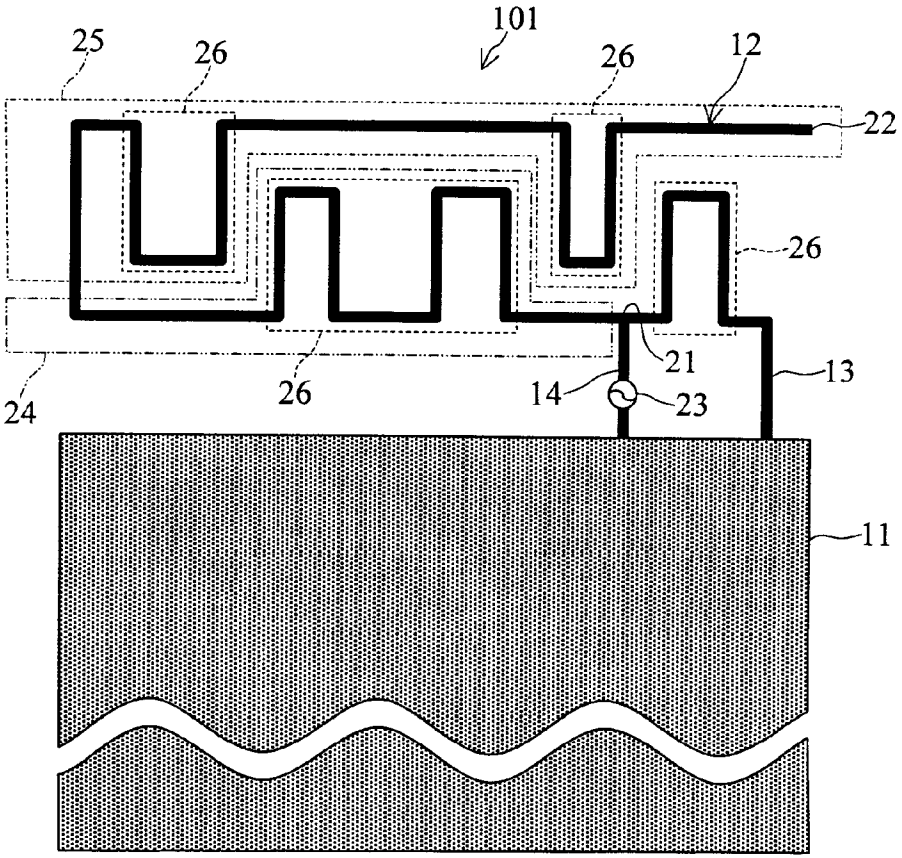
FIG. 1 shows an example of an antenna according to a first embodiment.

11: grounded conductor
12: radiation conductor

13: shorting pin
14: power feeder
21: one end
22: the other end
23: feeding point
24: lower arm
25: upper arm
26: meandered portion
31: local oscillation circuit
32: modulation circuit
33: local oscillation circuit
34: mixer
35: bandpass filter
36: RF amplifier
37: transmission antenna
41: reception antenna
42: bandpass filter
43: RF amplifier
44: local oscillation circuit
45: mixer
46: bandpass filter
47: IF amplifier
48: demodulation circuit
101, 102, 103, 104, 105, 106, 107, 108, 109, 110, 111, 112, 113, 114, 115, 116: antenna

BEST MODE FOR CARRYING OUT THE INVENTION

The following is a description of embodiments of the present invention, with reference to the accompanying drawings. The embodiments described below are merely examples of structures according to the present invention, and the present invention is not limited to the following embodiments.

First Embodiment

FIG. 1 shows an example of an antenna according to this embodiment. The antenna 101 according to this embodiment includes a grounded conductor 11, a radiation conductor 12, and a shorting pin 13. The antenna 101 has the shorting pin 13 provided between the grounded conductor 11 and the radiation conductor 12. The shorting pin 13 is formed with the portion between the edge of the grounded conductor 11 and a feeding point 23. The radiation conductor 12 has one end 21 connected to the shorting pin 13, and has the other end 22 left open. The radiation conductor 12 is roughly divided into a lower arm 24 and an upper arm 25 formed by bending the edge of the lower arm 24. To reduce the size of the antenna 101, a meandered structure is used. Power is supplied to the grounded conductor 11 and the radiation conductor 12 of the antenna 101 via the power feeder 14. The one end 21 of the radiation conductor 12 is connected to the power feeder 14, and has power supplied from the feeding point 23.

The radiation conductor 12 has the one end 21 connected to the grounded conductor 11 via the shorting pin 13, and has the other end 22 left open. The total length of the radiation conductor 12 contributes to the operation in the first resonance frequency band including the low-order resonance frequency. For example, the total length of the radiation conductor 12 is $\lambda_1/4$. Here, $\lambda_1$ is the wavelength of the free space of electromagnetic waves at the center frequency of the first resonance frequency band. In a case where a dielectric material exists near the radiation conductor 12, the wavelength is shortened, and therefore, the wavelength $\lambda_1$ is a shortened wavelength. In this manner, in the antenna 101, the first resonance frequency band can be adjusted by arranging the length of the radiation conductor 12.

The radiation conductor 12 is folded at a portion between the one end 21 and the other end 22, so as to form the lower arm 24 and the upper arm 25. Since the radiation conductor 12 is folded, the antenna can be made smaller. The lower arm 24 is the portion of the radiation conductor 12 closest to the grounded conductor 11. The upper arm 25 is the folded portion of the radiation conductor 12. If the upper arm 25 is not formed by bending the edge of the lower arm 24, the high-order resonance frequency $f_2$ is almost three times higher than the low-order resonance frequency $f_1$. Accordingly, if the low-order resonance frequency $f_1$ is 0.9 GHz, the high-order resonance frequency $f_2$ is 2.7 GHz, and the objective cannot be achieved. Since the upper arm 25 is formed by bending the edge of the lower arm 24, the high-order resonance frequency greatly shifts to the lower frequency side, compared with the high-order resonance frequency observed in a case where the folded portion is not formed. With this arrangement, the second resonance frequency band can be adjusted to a frequency band suitable for multiband operations, and accordingly, the antenna 101 can be used in multiband operations.

Figure 14:
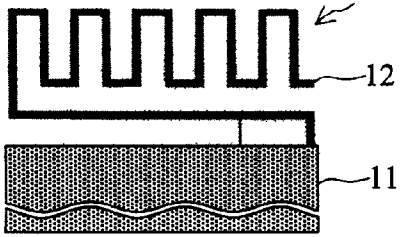
FIG. 14 shows examples of antenna structures.
Figure 14:
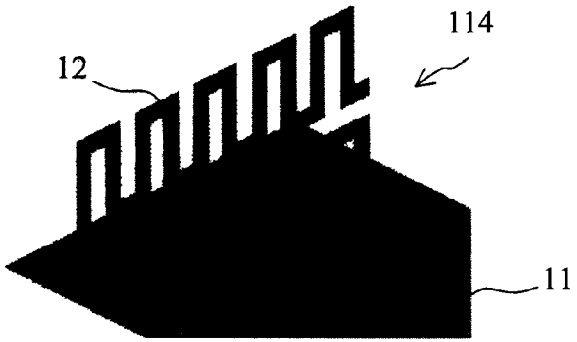
Figure 14:
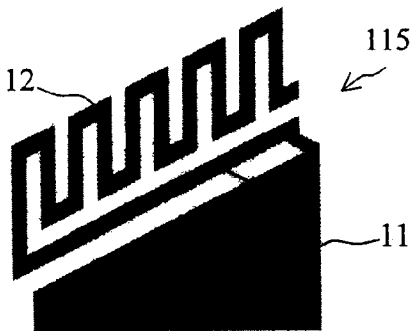
Figure 14:
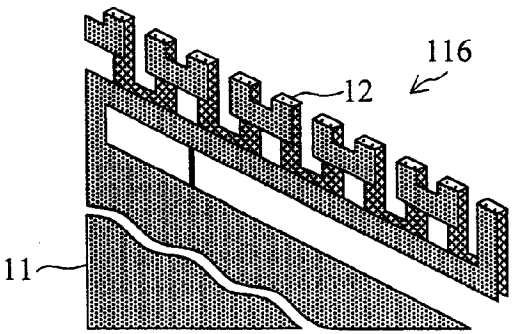

The lower arm 24 is bent in a meandered fashion, and extends along a straight line that keeps a fixed distance from the grounded conductor 11. For example, as shown in FIG. 1, if the portion of the grounded conductor 11 closest to the radiation conductor 12 is the edge of the grounded conductor 11, the lower arm 24 extends along a straight line parallel to the edge of the grounded conductor 11. Also, as shown in FIG. 14(*b*), if the portion of the grounded conductor 11 closest to the radiation conductor 12 is a plane of the ground conductor 11, the lower arm 24 extends along a straight line existing in a plane parallel to the plane of the grounded conductor 11. The upper arm 25 is bent in a meandered fashion, and extends in a direction that is parallel to but is opposite from the extending direction of the lower arm 24. As long as the extending directions of the lower arm 24 and the upper arm 25 are parallel to each other but are opposite from each other, the folded portion of the lower arm 24 and the upper arm 25 may not have a bent form, but may be a curved form such as a semicircular form or a shape like half a doughnut.

At least part of the lower arm 24 or the upper arm 25 has meandered portions 26. The meandered portions 26 of the lower arm 24 protrude toward the upper arm 25. The meandered portions 26 of the upper arm 25 protrude toward the lower arm 24. With the meandered portions 26 being formed, the volume of the antenna 101 can be made smaller. Accordingly, the antenna 101 is suitable as a small-size antenna that has a limited installation space. Further, in the antenna 101, the positions and number of the meandered portions 26 are adjusted, so as to change the resonance frequency of the antenna. Particularly, the second resonance frequency band including the high-order resonance frequency can be adjusted. With the use of the principles, resonance frequencies can be put into the frequency band to be used by mobile phone handsets. For example, the antenna 101 can have the second resonance frequency band that covers GSM, DCS, PCS, and UMTS.

Since the radiation conductor 12 is folded, the high-order resonance frequency shifts toward the lower frequency side. In this situation, further meandered portions 26 may be formed at the upper arm 25 or the lower arm 24, so that the high-order resonance frequency further shifts toward the lower frequency side, with almost no changes being made to the low-order resonance frequency. Here, by increasing the number of meandered portions 26, the high-order resonance frequency can be caused to further shift toward the lower frequency side. Also, by forming meandered portions 26 at the lower arm 24 rather than the upper arm 25, the high-order resonance frequency can be caused to easily shift toward the lower frequency side.

The antenna 101 can be adjusted so that consistency can be ensured in a desired frequency band, and the radiation characteristics of the antenna 101 are substantially omnidirectional, as will be apparent from the later described embodiments and examples. This is because the positions of the meandered portions 26 of the upper arm 25 and the lower arm 24 are changed so as to change the position of the current distribution contributing to radiation, and accordingly, the directionality of the radiation characteristics can be adjusted.

The shorting pin 13 causes short-circuiting between the grounded conductor 11 and the radiation conductor 12. Here, it is preferable that the shorting pin 13 has meandered portions 26. In FIG. 1, meandered portions 26 are formed at portions of the shorting pin 13 that are parallel to the edge of the grounded conductor 11. As a meandered structure is formed at the shorting pin 13, the resonance frequency band of the antenna 101 can be greatly widened. Particularly, the second resonance frequency band including the high-order resonance frequency can be greatly widened. Also, by forming a meandered structure at the shorting pin 13, the radiation characteristics can be made substantially omnidirectional.

In the antenna 101, it is preferable that the radiation conductor 12 and the shorting pin 13 are formed with a single continuous conductor line. It is also preferable that the radiation conductor 12 is formed with a metal line or a metal film. For example, except for the power feeder 14, the antenna 101 is formed with a single metal line without a branch. This structure may be formed with a very thin metal film or a metal wire. In such a case, the antenna can be produced at very low costs. In a case where the radiation conductor 12 is formed with a metal film, it is preferable that the radiation conductor 12 is formed on a flexible substrate. If the radiation conductor 12 is formed on a flexible substrate, the radiation conductor 12 can be easily folded while maintaining the meandered portions 26.

Even if the antenna 101 is placed in an arbitrary position relative to the grounded conductor 11, the position hardly affects the characteristics. This gives a high degree of freedom to the installation position of the antenna 101, and makes the antenna design easier. For example, the radiation conductor 12 may be placed in the same plane as the grounded conductor 11. Since the radiation conductor 12 is placed in the same plane as the grounded conductor 11, the grounded conductor 11 and the radiation conductor 12 can be formed on the same substrate. Alternatively, the radiation conductor 12 may be placed in a plane different from the plane in which the grounded conductor 11 is placed. The antenna 101 can be made smaller in size, without a change in the resonance frequency characteristics.

In the antenna 101, it is preferable that the radiation conductor 12 is folded at least once along a straight line parallel to the extending direction of the lower arm 24 or the upper arm 25, or a straight line keeping a fixed distance from the nearest portion of the grounded conductor 11. As will be explained later in the seventh, the eighth, and the ninth embodiments, the resonance frequency characteristics are not affected by folding the radiation conductor 12 along a straight line that keeps a fixed distance from the nearest portion of the grounded conductor 11. Accordingly, the antenna 101 can be made smaller in size, without a change being made to the resonance frequency characteristics.

In the antenna 101, it is preferable that the folded radiation conductor 12 is fixed to a dielectric material. Since the radiation conductor 12 is fixed, the meandered portions 26 can be maintained. The radiation conductor 12 may be fixed to the edge of the substrate, for example. A circuit in a wireless communication device may be formed with a stack structure, and the surface of the circuit may be shielded so that the radiation conductor 12 can be fixed to the surrounding area of the circuit. Even if a shock is applied to the wireless communication device, the meandered portions 26 can be maintained, since the radiation conductor 12 is fixed. Also, since a dielectric material exists near the radiation conductor 12, the low-order resonance frequency can be made lower. Thus, the first resonance frequency band of the antenna can also be adjusted.

Second Embodiment

Figure 2:
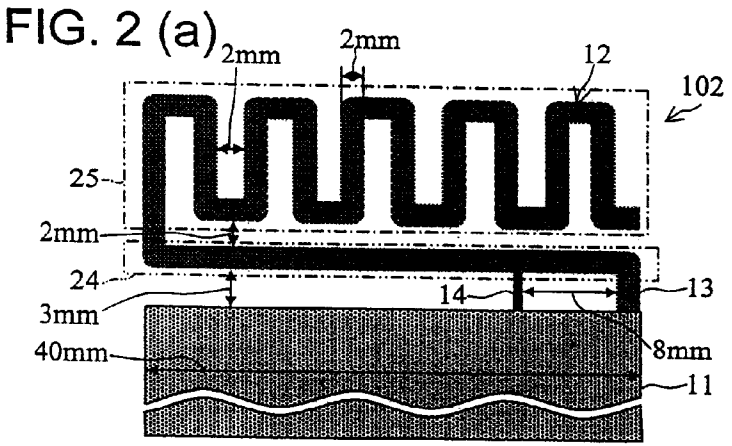
FIG. 2 shows an example of an antenna according to a second embodiment.
Figure 2:
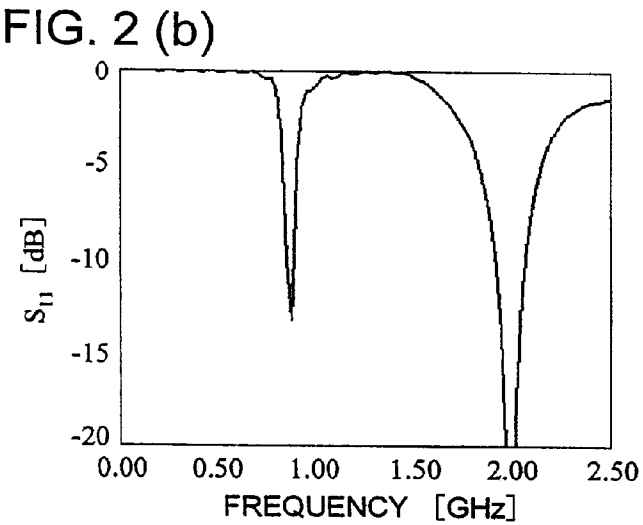
Figure 2:
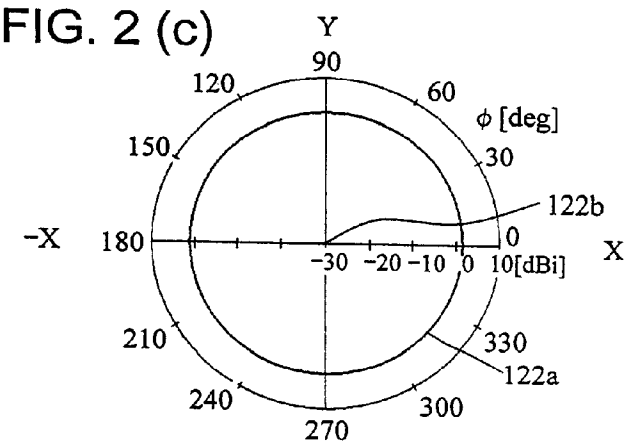
Figure 2:
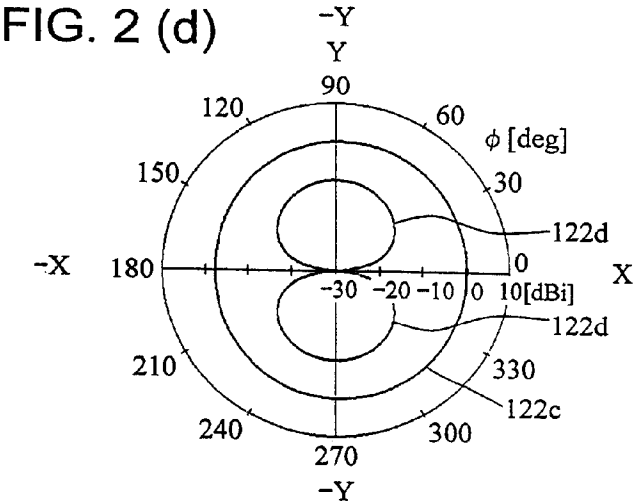

FIG. 2 shows an example of an antenna according to this embodiment: FIG. 2(*a*) shows the structure of the antenna; FIG. 2(*b*) shows the input characteristics of the antenna; and FIG. 2(*c*) and FIG. 2(*d*) show the radiation characteristics in the x-y plane. In the antenna 102, the upper arm has five meandered portions.

Referring to FIG. 2(*a*), an example structure of the antenna 102 is described. The size of the grounded conductor 11 is 70×40 $mm^2$. The distance between the radiation conductor 12 and the grounded conductor 11 is 3 mm. The shorting pin 13 is connected to the edge of the grounded conductor 11. The power feeder 14 is connected to a spot that is located 8 mm inside from the edge of the grounded conductor 11 to which the shorting pin 13 is connected. The radiation conductor 12 is a planar structure, and the size of the entire radiation conductor 12 is 40×15 $mm^2$. The radiation conductor 12 is formed with one line. The width of the radiation conductor 12 is 2 mm. The distance between each two adjacent portions of the radiation conductor 12 is 2 mm. The thickness of the radiation conductor 12 is equal to or greater than the skin depth observed at 0.9 GHz. For example, in a case where the radiation conductor 12 is formed with a metal film, the radiation conductor 12 is copper foil of 10 μm or greater in thickness. In this embodiment, the radiation conductor 12 is integrally formed with the shorting pin 13. The same applies to the later described embodiments.

The input characteristics of an antenna shown in FIG. 2(*b*) are the result of a simulation of the input characteristics of the antenna 102, and are represented by the absolute values of the scattering parameter $S_{11}$. Here, the characteristic impedance of the system at the feeding point 23 of the antenna 102 is 50Ω. The resonance frequencies at which the scattering parameter $S_{11}$ becomes small are approximately 0.85 GHz and approximately 2.00 GHz.

Figure 3:
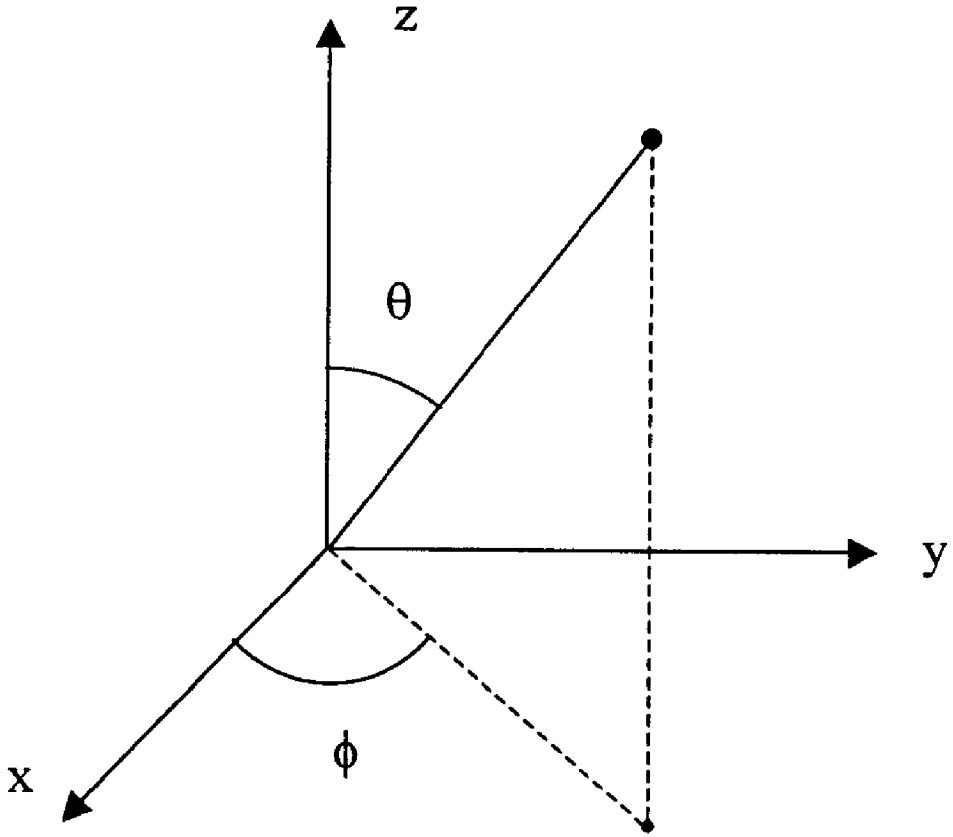
FIG. 3 shows the polar coordinates used in this embodiment.

The radiation characteristics in the x-y plane shown in FIG. 2(*c*) are the result of a simulation at the low-order resonance frequency of 0.85 GHz. The radiation characteristics in the x-y plane shown in FIG. 2(*d*) are the result of a simulation at the high-order resonance frequency of 2.00 GHz. The radiation characteristics are represented in the polar coordinates shown in FIG. 3. At the low-order resonance frequency of 0.85 GHz, the directionality in the entire structure and θ-direction is as indicated by a radiation pattern 122*a*, and the directionality in the ϕ-direction is as indicated by a radiation pattern 122*b*. At high-order resonance frequency of 2.00 GHz, the directionality in the entire structure and θ-direction is as indicated by a radiation pattern 122*c*, and the directionality in the ϕ-direction is as indicated by a radiation pattern

122*d*. As shown in FIG. 2(*c*) and FIG. 2(*d*), excellent omnidirectionality is achieved at either resonance frequency.

Third Embodiment

Figure 4:
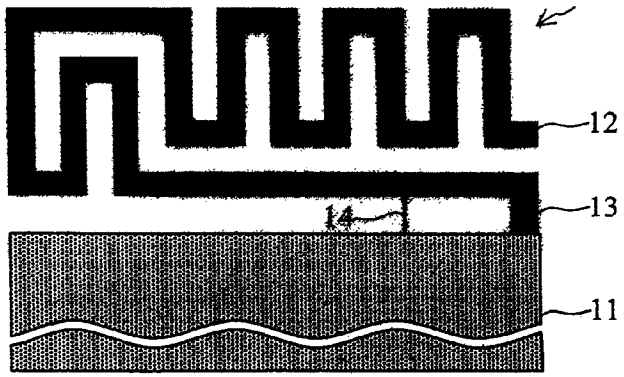
FIG. 4 shows an example of an antenna according to a third embodiment.
Figure 4:
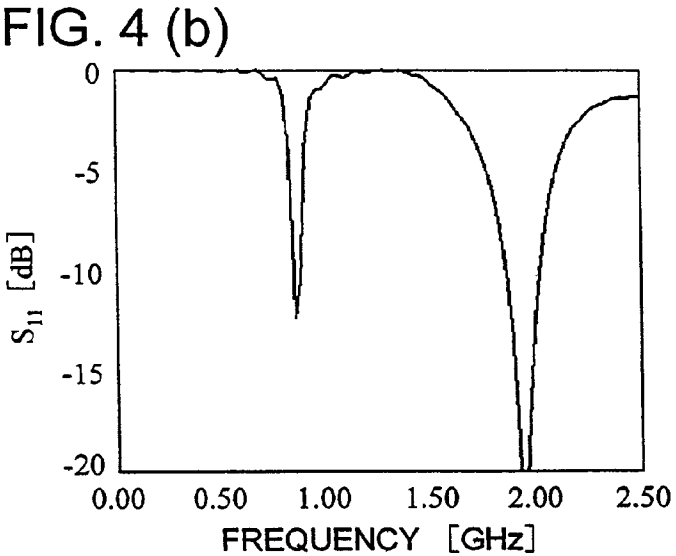
Figure 4:
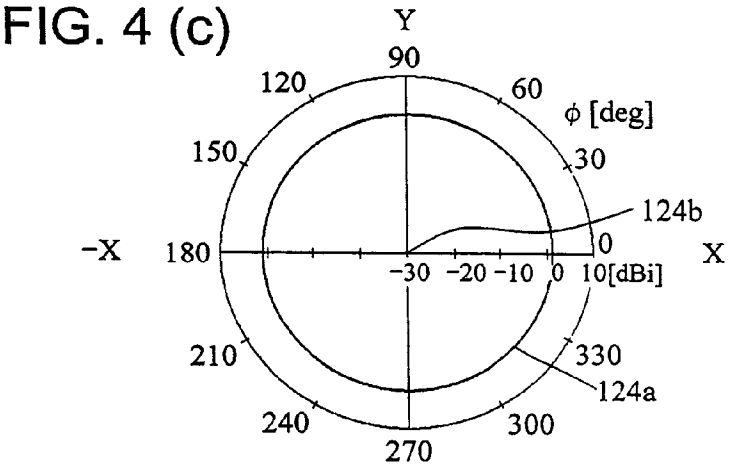
Figure 4:
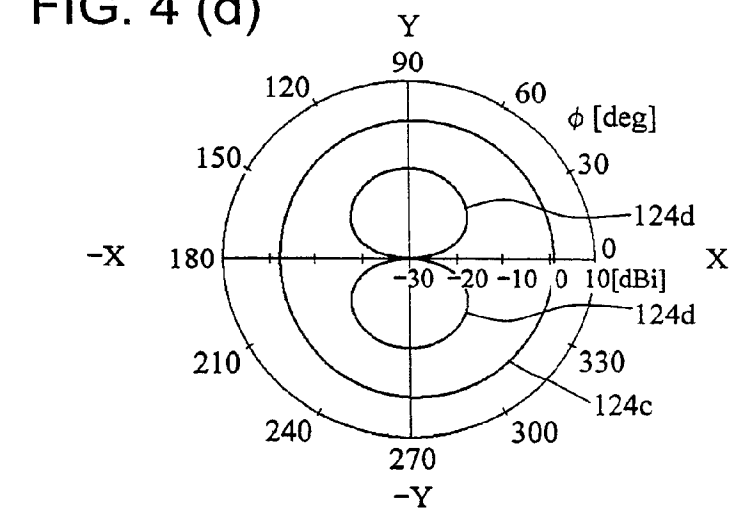

FIG. 4 shows an example of an antenna according to this embodiment: FIG. 4(*a*) shows the structure of the antenna; FIG. 4(*b*) shows the input characteristics of the antenna; and FIG. 4(*c*) and FIG. 4(*d*) show the radiation characteristics in the x-y plane. In the antenna 103, the upper arm has four meandered portions, and the lower arm has one meandered portion. The other aspects of this structure, such as the size of the grounded conductor 11, the distance between the radiation conductor 12 and the grounded conductor 11, the positions of the shorting pin 13 and the power feeder 14, the width of the radiation conductor 12, and the distance between each two adjacent portions of the radiation conductor 12, are the same as those in the second embodiment.

The input characteristics of an antenna shown in FIG. 4(*b*) are the result of a simulation of the input characteristics of the antenna 103, and are represented by the absolute values of the scattering parameter $S_{11}$. The resonance frequencies at which the scattering parameter $S_{11}$ becomes small are approximately 0.85 GHz and approximately 1.95 GHz. As can be seen from the input characteristics, the high-order resonance frequency of the antenna 103 is lower than that of the input characteristics of the antenna 102 shown in FIG. 2(*b*).

The radiation characteristics in the x-y plane shown in FIG. 4(*c*) are the result of a simulation at the low-order resonance frequency of 0.85 GHz. The radiation characteristics in the x-y plane shown in FIG. 4(*d*) are the result of a simulation at the high-order resonance frequency of 1.95 GHz. The radiation characteristics are represented in the polar coordinates shown in FIG. 3. At the low-order resonance frequency of 0.85 GHz, the directionality in the entire structure and θ-direction is as indicated by a radiation pattern 124*a*, and the directionality in the ϕ-direction is as indicated by a radiation pattern 124*b*. At high-order resonance frequency of 1.95 GHz, the directionality in the entire structure and θ-direction is as indicated by a radiation pattern 124*c*, and the directionality in the ϕ-direction is as indicated by a radiation pattern 124*d*. As can be seen from FIG. 4(*c*) and FIG. 4(*d*), excellent omnidirectionality is achieved at either resonance frequency.

Fourth Embodiment

Figure 5:
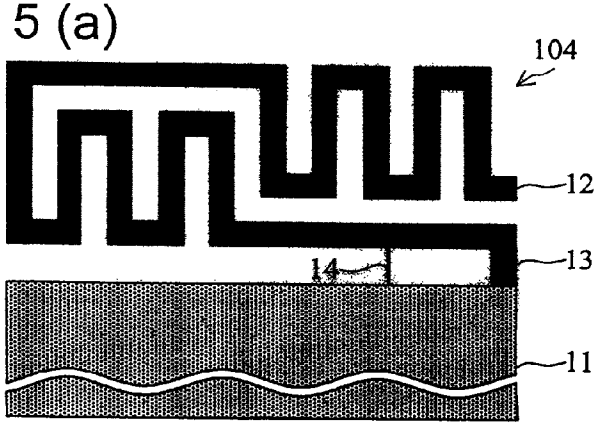
FIG. 5 shows an example of an antenna according to a fourth embodiment.
Figure 5:
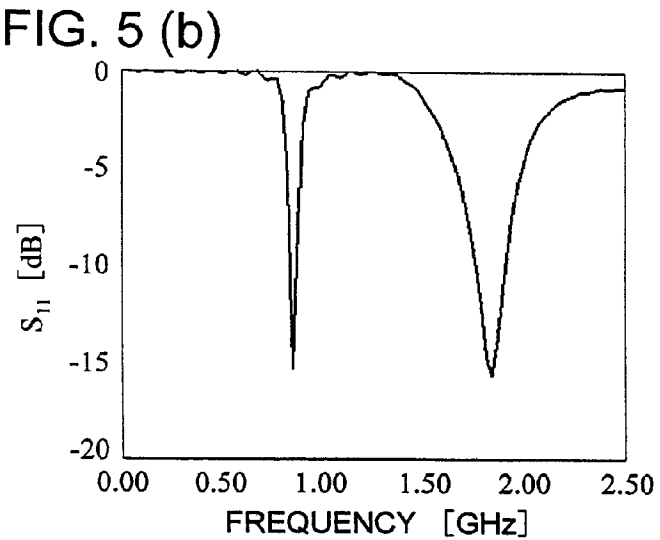
Figure 5:
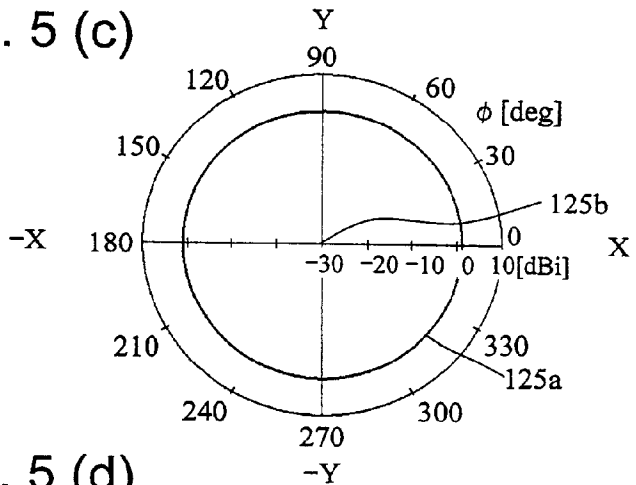
Figure 5:
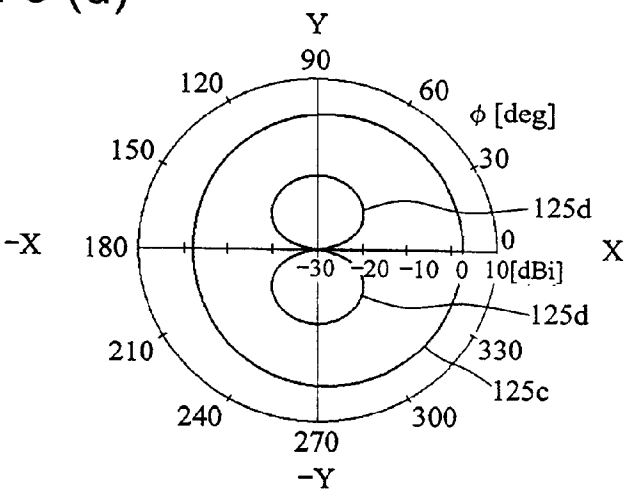

FIG. 5 shows an example of an antenna according to this embodiment: FIG. 5(*a*) shows the structure of the antenna; FIG. 5(*b*) shows the input characteristics of the antenna; and FIG. 5(*c*) and FIG. 5(*d*) show the radiation characteristics in the x-y plane. In the antenna 104, the upper arm has three meandered portions, and the lower arm has two meandered portions. The other aspects of this structure, such as the size of the grounded conductor 11, the distance between the radiation conductor 12 and the grounded conductor 11, the positions of the shorting pin 13 and the power feeder 14, the width of the radiation conductor 12, and the distance between each two adjacent portions of the radiation conductor 12, are the same as those in the second embodiment.

The input characteristics of an antenna shown in FIG. 5(*b*) are the result of a simulation of the input characteristics of the antenna 104, and are represented by the absolute values of the scattering parameter $S_{11}$. The resonance frequencies at which the scattering parameter $S_{11}$ becomes small are approximately 0.85 GHz and approximately 1.80 GHz. As can be seen from the input characteristics, the high-order resonance frequency of the antenna 104 moves to the low frequency side that is lower than the input characteristics of the antenna 103 shown in FIG. 4(*b*).

The radiation characteristics in the x-y plane shown in FIG. 5(*c*) are the result of a simulation at the low-order resonance frequency of 0.85 GHz. The radiation characteristics in the x-y plane shown in FIG. 5(*d*) are the result of a simulation at the high-order resonance frequency of 1.80 GHz. The radiation characteristics are represented in the polar coordinates shown in FIG. 3. At the low-order resonance frequency of 0.85 GHz, the directionality in the entire structure and θ-direction is as indicated by a radiation pattern 125*a*, and the directionality in the ϕ-direction is as indicated by a radiation pattern 125*b*. At high-order resonance frequency of 1.80 GHz, the directionality in the entire structure and θ-direction is as indicated by a radiation pattern 125*c*, and the directionality in the ϕ-direction is as indicated by a radiation pattern 125*d*. As can be seen from FIG. 5(*c*) and FIG. 5(*d*), excellent omnidirectionality is achieved at either resonance frequency.

Fifth Embodiment

Figure 6:
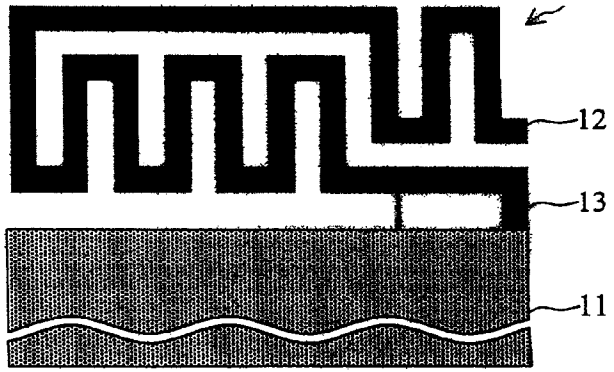
FIG. 6 shows an example of an antenna according to a fifth embodiment.
Figure 6:
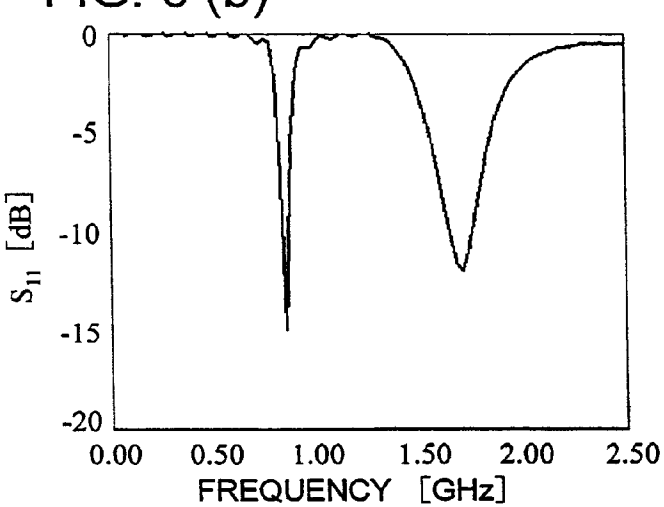
Figure 6:
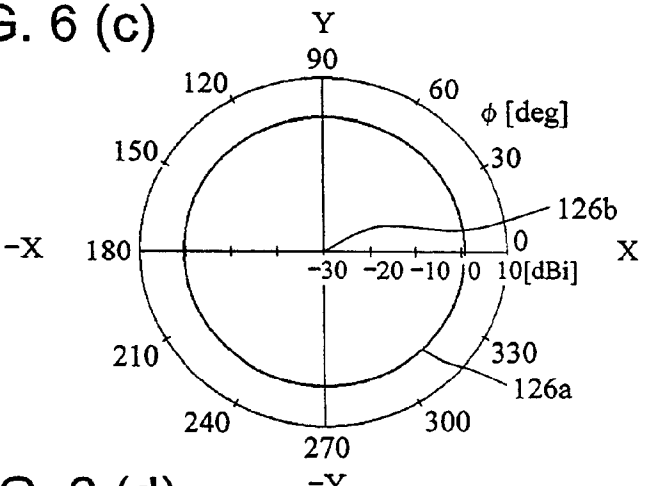
Figure 6:
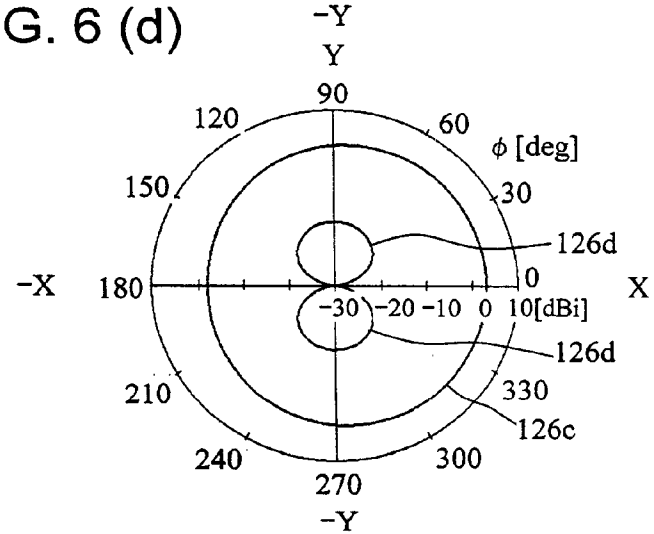

FIG. 6 shows an example of an antenna according to this embodiment: FIG. 6(*a*) shows the structure of the antenna; FIG. 6(*b*) shows the input characteristics of the antenna; and FIG. 6(*c*) and FIG. 6(*d*) show the radiation characteristics in the x-y plane. In the antenna 105, the upper arm has two meandered portions, and the lower arm has three meandered portions. The other aspects of this structure, such as the size of the grounded conductor 11, the distance between the radiation conductor 12 and the grounded conductor 11, the positions of the shorting pin 13 and the power feeder 14, the width of the radiation conductor 12, and the distance between each two adjacent portions of the radiation conductor 12, are the same as those in the second embodiment.

The input characteristics of an antenna shown in FIG. 6(*b*) are the result of a simulation of the input characteristics of the antenna 105, and are represented by the absolute values of the scattering parameter $S_{11}$. The resonance frequencies at which the scattering parameter $S_{11}$ becomes small are approximately 0.85 GHz and approximately 1.70 GHz. As can be seen from the input characteristics, the high-order resonance frequency of the antenna 105 is lower than that of the input characteristics of the antenna 104 of the fourth embodiment shown in FIG. 5(*b*).

The radiation characteristics in the x-y plane shown in FIG. 6(*c*) are the result of a simulation at the low-order resonance frequency of 0.85 GHz. The radiation characteristics in the x-y plane shown in FIG. 6(*d*) are the result of a simulation at the high-order resonance frequency of 1.70 GHz. The radiation characteristics are represented in the polar coordinates shown in FIG. 3. At the low-order resonance frequency of 0.85 GHz, the directionality in the entire structure and θ-direction is as indicated by a radiation pattern 126*a*, and the directionality in the ϕ-direction is as indicated by a radiation pattern 126*b*. At high-order resonance frequency of 1.70 GHz, the directionality in the entire structure and θ-direction is as indicated by a radiation pattern 126*c*, and the directionality in the ϕ-direction is as indicated by a radiation pattern 126*d*. As can be seen from FIG. 6(*c*) and FIG. 6(*d*), excellent omnidirectionality is achieved at either resonance frequency.

Sixth Embodiment

Figure 7:
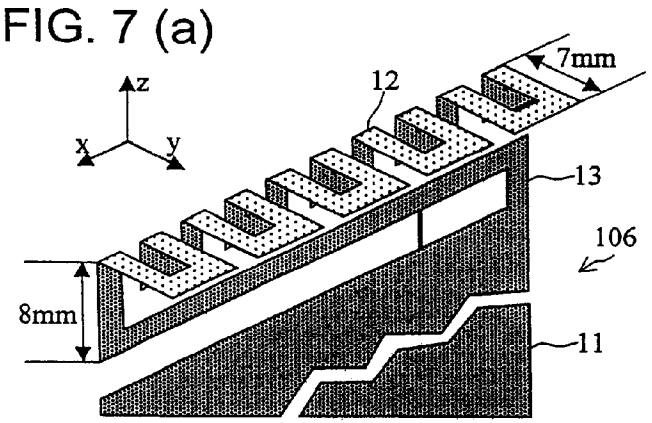
FIG. 7 shows an example of an antenna according to a sixth embodiment.
Figure 7:
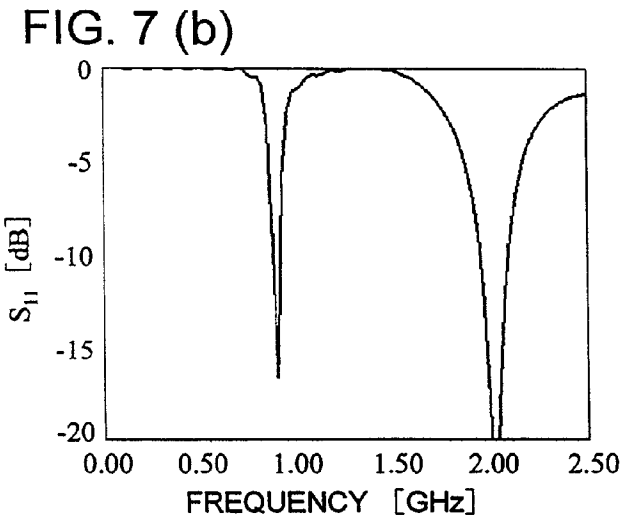
Figure 7:
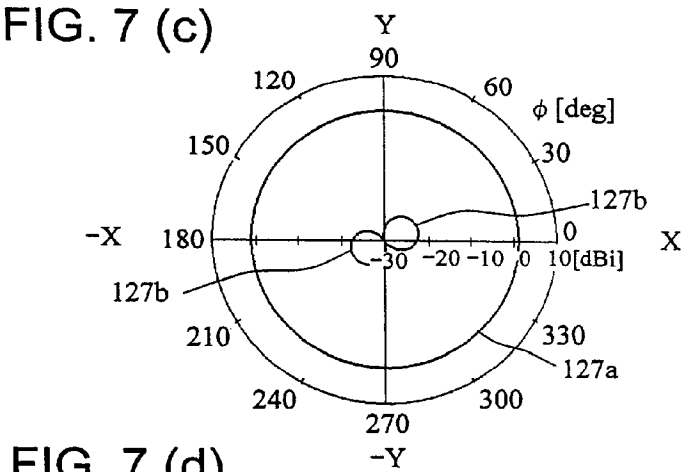
Figure 7:
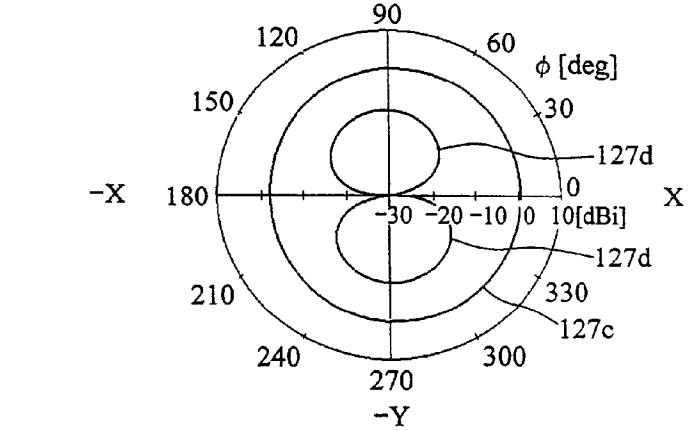

FIG. 7 shows an example of an antenna according to this embodiment: FIG. 7(*a*) shows the structure of the antenna; FIG. 7(*b*) shows the input characteristics of the antenna; and FIG. 7(*c*) and FIG. 7(*d*) show the radiation characteristics in the x-y plane. The antenna 106 has the same structure as the antenna 102 shown in FIG. 2, except that the upper arm is bent once along a straight line parallel to the extending direction of the upper arm. In a case where the plane of the grounded conductor 11 is the x-y plane, the bent upper arm is in the x-y plane. The bent line is located at a position that is 8 mm away from the base of the lower arm. The volume of the space occupied by the radiation conductor 12 is 40×8×7 $mm^3$. Although only the upper arm is bent in this embodiment, the upper arm is not necessarily bent. In a case where the lower arm or the shorting pin has meandered portions, the lower arm or the shorting pin may be bent. The same applies to the later described embodiments.

The input characteristics of an antenna shown in FIG. 7(*b*) are the result of a simulation of the input characteristics of the antenna 106, and are represented by the absolute values of the scattering parameter $S_{11}$. The resonance frequencies at which the scattering parameter $S_{11}$ becomes small are approximately 0.90 GHz and approximately 2.00 GHz. The resonance frequencies of the antenna 106 hardly differ from those of the antenna 102 shown in FIG. 2.

The radiation characteristics in the x-y plane shown in FIG. 7(*c*) are the result of a simulation at the low-order resonance frequency of 0.90 GHz. The radiation characteristics in the x-y plane shown in FIG. 7(*d*) are the result of a simulation at the high-order resonance frequency of 2.00 GHz. The radiation characteristics are represented in the polar coordinates shown in FIG. 3. At the low-order resonance frequency of 0.90 GHz, the directionality in the entire structure and θ-direction is as indicated by a radiation pattern 127*a*, and the directionality in the ϕ-direction is as indicated by a radiation pattern 127*b*. At high-order resonance frequency of 2.00 GHz, the directionality in the entire structure and θ-direction is as indicated by a radiation pattern 127*c*, and the directionality in the ϕ-direction is as indicated by a radiation pattern 127*d*. As can be seen from FIG. 7(*c*) and FIG. 7(*d*), excellent omnidirectionality is achieved at either resonance frequency. The bent radiation conductor 12 may be wound around a dielectric material. By doing so, not only the antenna shape can be maintained, but also the antenna size can be reduced by the dielectric material.

Seventh Embodiment

Figure 8:
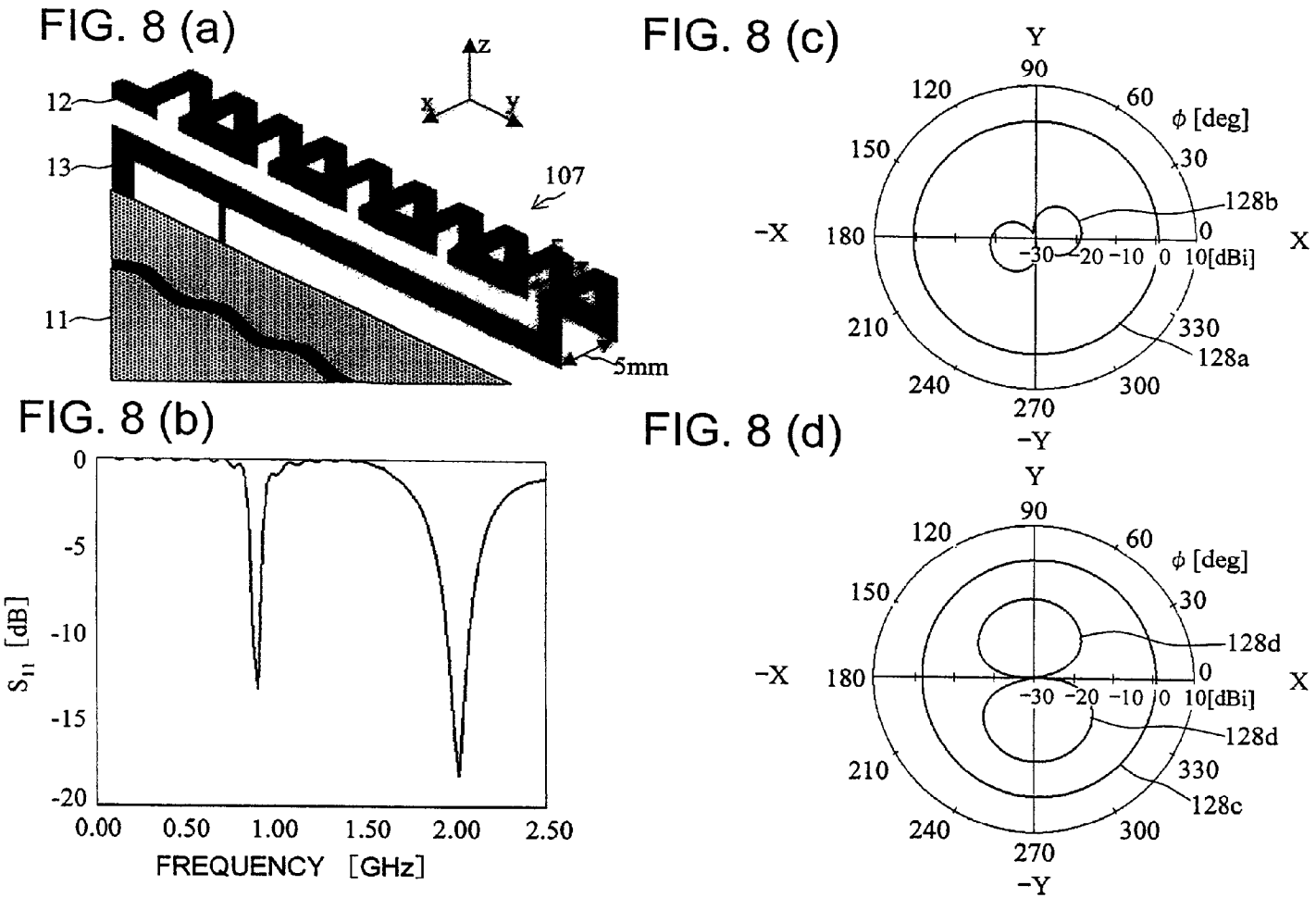
FIG. 8 shows an example of an antenna according to a seventh embodiment.

FIG. 8 shows an example of an antenna according to this embodiment: FIG. 8(*a*) shows the structure of the antenna; FIG. 8(*b*) shows the input characteristics of the antenna; and FIG. 8(*c*) and FIG. 8(*d*) show the radiation characteristics in the x-y plane. The antenna 107 has the same structure as the antenna 102 shown in FIG. 2, except that the upper arm is bent twice along straight lines parallel to the extending direction of the upper arm. The first one of the bent lines is located at a position that is 5 mm away from the base of the lower arm, and the second one of the bent lines is located at a position that is further 5 mm away from the first bent line. The volume of the space occupied by the radiation conductor 12 is 40×5×5 $mm^3$.

The input characteristics of an antenna shown in FIG. 8(*b*) are the result of a simulation of the input characteristics of the antenna 107, and are represented by the absolute values of the scattering parameter $S_{11}$. The resonance frequencies at which the scattering parameter $S_{11}$ becomes small are approximately 0.90 GHz and approximately 2.00 GHz. The resonance frequencies of the antenna 107 hardly differ from those of the antenna 102 shown in FIG. 2.

The radiation characteristics in the x-y plane shown in FIG. 8(*c*) are the result of a simulation at the low-order resonance frequency of 0.90 GHz. The radiation characteristics in the x-y plane shown in FIG. 8(*d*) are the result of a simulation at the high-order resonance frequency of 2.00 GHz. The radiation characteristics are represented in the polar coordinates shown in FIG. 3. At the low-order resonance frequency of 0.90 GHz, the directionality in the entire structure and θ-direction is as indicated by a radiation pattern 128*a*, and the directionality in the ϕ-direction is as indicated by a radiation pattern 128*b*. At high-order resonance frequency of 2.00 GHz, the directionality in the entire structure and θ-direction is as indicated by a radiation pattern 128*c*, and the directionality in the ϕ-direction is as indicated by a radiation pattern 128*d*. As can be seen from FIG. 8(*c*) and FIG. 8(*d*), excellent omnidirectionality is achieved at either resonance frequency. The bent radiation conductor 12 may be wound around a dielectric material. By doing so, not only the meandered portion of the radiation conductor 12 can be maintained, but also the antenna size can be reduced by the dielectric material.

Eighth Embodiment

Figure 9:
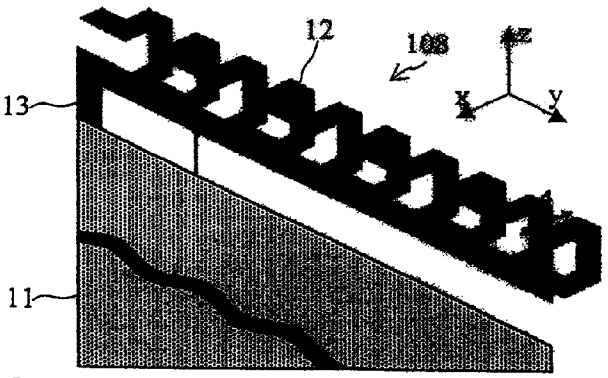
FIG. 9 shows an example of an antenna according to an eighth embodiment.
Figure 9:
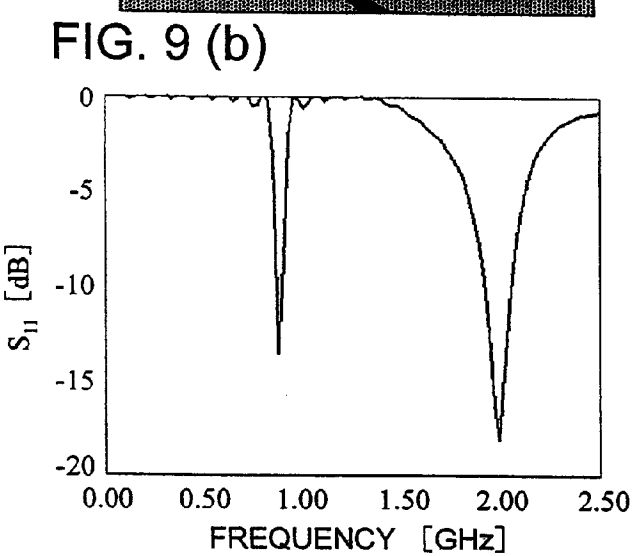
Figure 9:
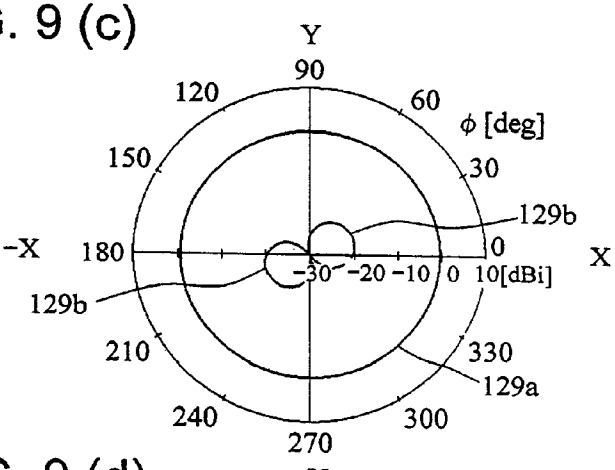
Figure 9:
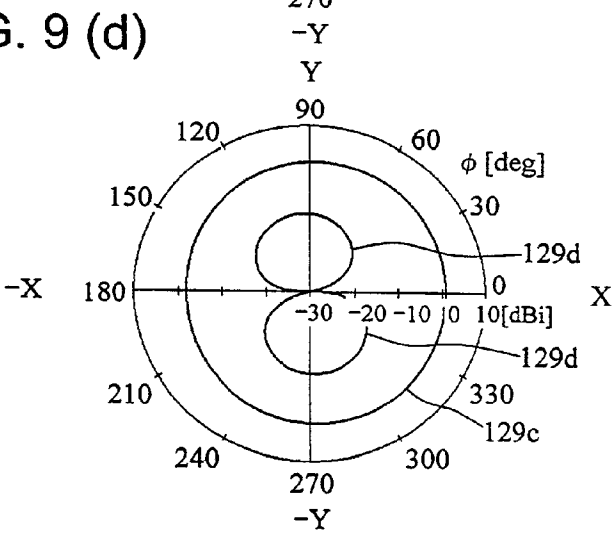

FIG. 9 shows an example of an antenna according to this embodiment: FIG. 9(*a*) shows the structure of the antenna; FIG. 9(*b*) shows the input characteristics of the antenna; and FIG. 9(*c*) and FIG. 9(*d*) show the radiation characteristics in the x-y plane. The antenna 108 has the same structure as the antenna 102 shown in FIG. 2, except that the upper arm is bent three times along straight lines parallel to the extending direction of the upper arm. The first one of the bent lines is located at a position that is 4 mm away from the base of the lower arm, the second one of the bent lines is located at a position that is further 4 mm away from the first bent line, and the third one of the bent lines is located at a position that is further 4 mm away from the second bent line. The volume of the space occupied by the radiation conductor 12 is 40×4×4 $mm^3$.

The input characteristics of an antenna shown in FIG. 9(*b*) are the result of a simulation of the input characteristics of the antenna 108, and are represented by the absolute values of the scattering parameter $S_{11}$. The resonance frequencies at which the scattering parameter $S_{11}$ becomes small are approximately 0.90 GHz and approximately 2.00 GHz. The resonance frequencies of the antenna 108 hardly differ from those of the antenna 102 shown in FIG. 2.

The radiation characteristics in the x-y plane shown in FIG. 9(*c*) are the result of a simulation at the low-order resonance frequency of 0.90 GHz. The radiation characteristics in the x-y plane shown in FIG. 9(*d*) are the result of a simulation at the high-order resonance frequency of 2.00 GHz. The radiation characteristics are represented in the polar coordinates shown in FIG. 3. At the low-order resonance frequency of 0.90 GHz, the directionality in the entire structure and θ-direction is as indicated by a radiation pattern 129*a*, and the directionality in the ϕ-direction is as indicated by a radiation pattern 129*b*. At high-order resonance frequency of 2.00 GHz, the directionality in the entire structure and θ-direction is as indicated by a radiation pattern 129*c*, and the directionality in the ϕ-direction is as indicated by a radiation pattern 129*d*. As can be seen from FIG. 9(*c*) and FIG. 9(*d*), excellent omnidirectionality is achieved in either frequency band. The bent radiation conductor 12 may be wound around a dielectric material. By doing so, not only the antenna shape can be maintained, but also the antenna size can be reduced by the dielectric material.

Ninth Embodiment

Figure 10:
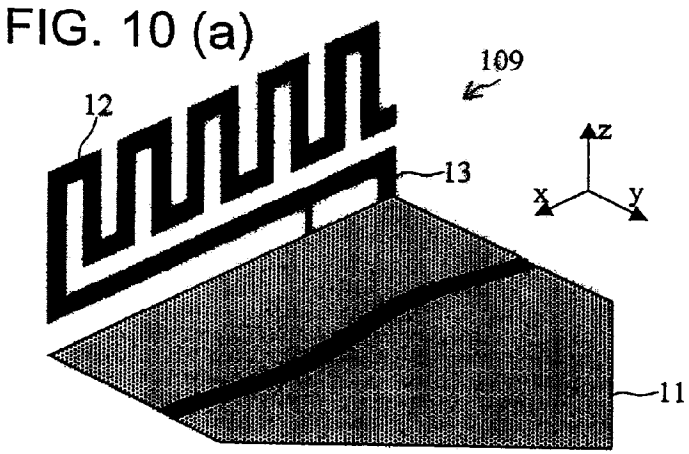
FIG. 10 shows an example of an antenna according to a ninth embodiment.
Figure 10:
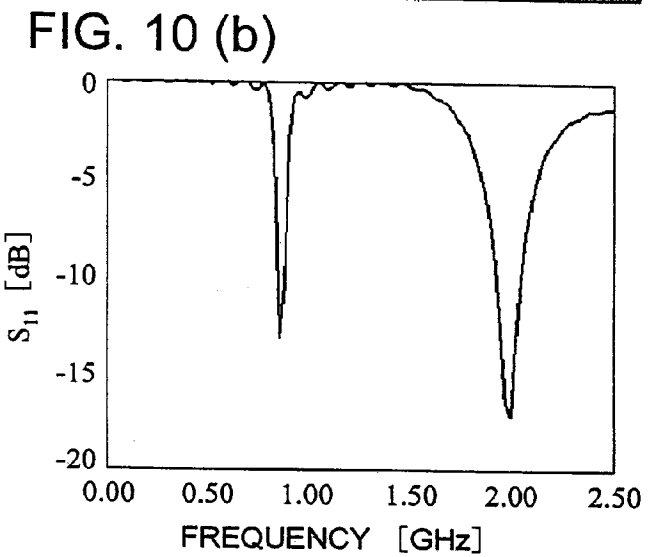
Figure 10:
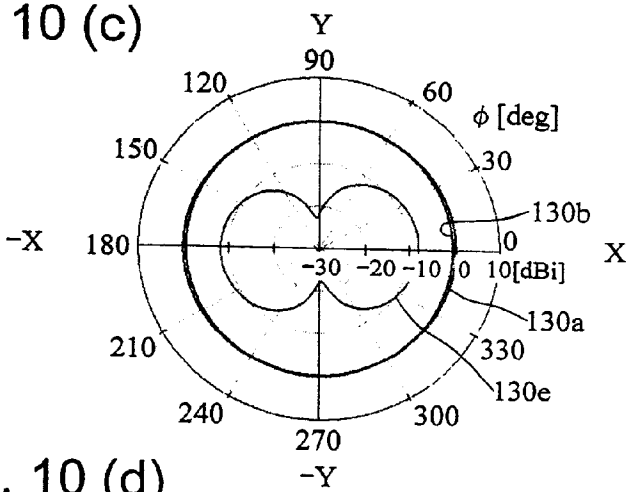
Figure 10:
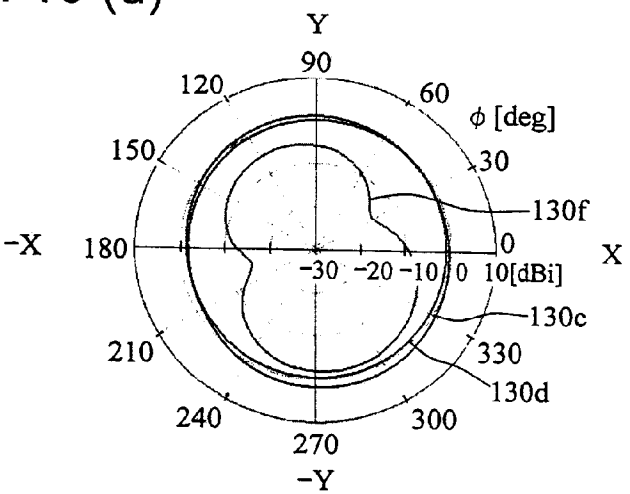

FIG. 10 shows an example of an antenna according to this embodiment: FIG. 10(*a*) shows the structure of the antenna;

FIG. 10(*b*) shows the input characteristics of the antenna; and FIG. 10(*c*) and FIG. 10(*d*) show the radiation characteristics in the x-y plane. The antenna 109 has the same structure as the antenna 102 shown in FIG. 2, except that the radiation conductor 12 is placed perpendicular to the grounded conductor 11. For example, in a case where coordinate axes are adjusted to the radiation conductor 12, and the radiation conductor 12 is placed in the x-z plane, the ground conductor 11 is placed in the x-y plane.

The input characteristics of an antenna shown in FIG. 10(*b*) are the result of a simulation of the input characteristics of the antenna 109, and are represented by the absolute values of the scattering parameter $S_{11}$. The resonance frequencies at which the scattering parameter $S_{11}$ becomes small are approximately 0.85 GHz and approximately 2.00 GHz. The resonance frequencies of the antenna 109 hardly differ from those of the antenna 102 shown in FIG. 2.

The radiation characteristics in the x-y plane shown in FIG. 10(*c*) are the result of a simulation at the low-order resonance frequency of 0.85 GHz. The radiation characteristics in the x-y plane shown in FIG. 10(*d*) are the result of a simulation at the high-order resonance frequency of 2.00 GHz. The radiation characteristics are represented in the polar coordinates shown in FIG. 3. At the low-order resonance frequency of 0.85 GHz, the directionality in the entire structure is as indicated by a radiation pattern 130*a*, the directionality in the θ-direction is as indicated by a radiation pattern 130*e*, and the directionality in the ϕ-direction is as indicated by a radiation pattern 130*b*. At high-order resonance frequency of 2.00 GHz, the directionality in the entire structure is as indicated by a radiation pattern 130*c*, the directionality in the θ-direction is as indicated by a radiation pattern 130*f*, and the directionality in the ϕ-direction is as indicated by a radiation pattern 130*d*. As can be seen from FIG. 10(*c*) and FIG. 10(*d*), excellent omnidirectionality is achieved at either resonance frequency.

Tenth Embodiment

Figure 11:
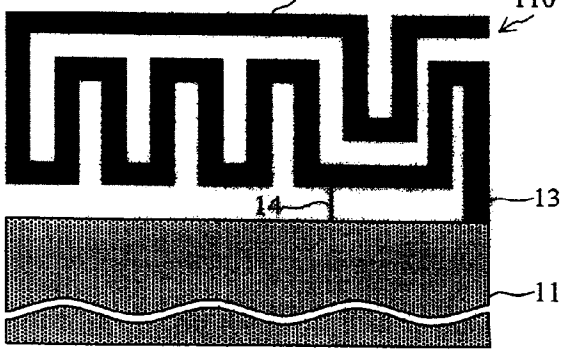
FIG. 11 shows an example of an antenna according to a tenth embodiment.
Figure 11:
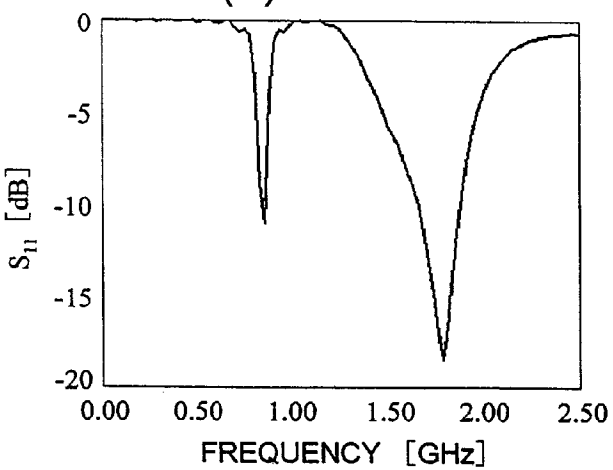
Figure 11:
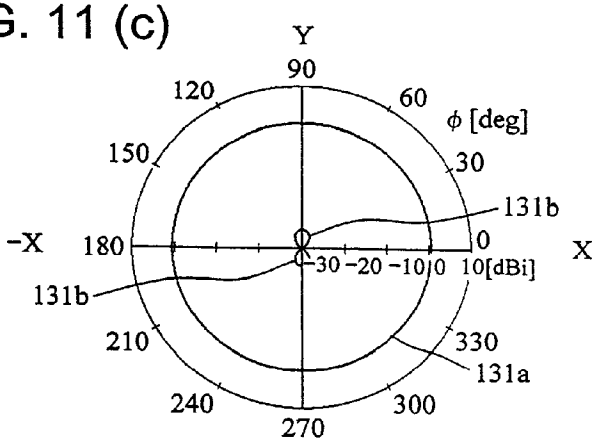
Figure 11:
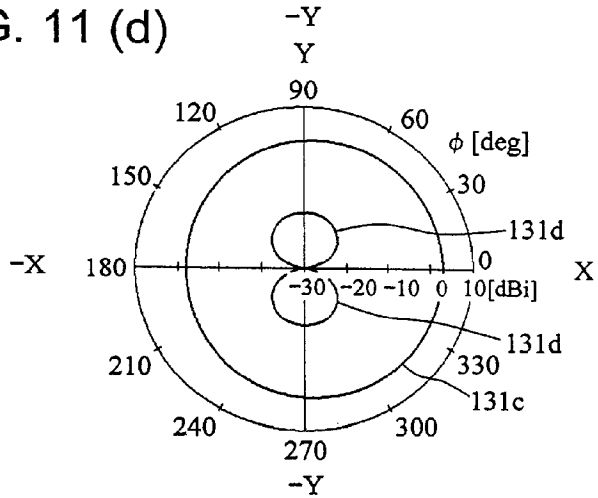

FIG. 11 shows an example of an antenna according to this embodiment: FIG. 11(*a*) shows the structure of the antenna; FIG. 11(*b*) shows the input characteristics of the antenna; and FIG. 11(*c*) and FIG. 11(*d*) show the radiation characteristics in the x-y plane. The antenna 110 has the same structure as the antenna 105 shown in FIG. 6, except that the upper arm has one meandered portions, reduced from two, and the shorting pin 13 has a meandered portion. The power feeder 14 is at a distance of 11 mm from the connecting point between the shorting pin 13 and the grounded conductor 11, so as to keep consistency. As described above, the antenna 110 is the same as the antenna 105, except that the shorting pin 13 is a meandered portion.

The input characteristics of an antenna shown in FIG. 11(*b*) are the result of a simulation of the input characteristics of the antenna 110, and are represented by the absolute values of the scattering parameter $S_{11}$. The resonance frequencies at which the scattering parameter $S_{11}$ becomes small are approximately 0.85 GHz and approximately 1.80 GHz. The second resonance frequency band that satisfies $|S_{11}| \leqq -5$ dB is the band from 1.45 GHz to 1.95 GHz. Although the second resonance frequency band that satisfies $|S_{11}| \leqq -5$ dB is the band from 1.55 GHz to 1.85 GHz in the antenna 105 shown in FIG. 6, the second resonance frequency band is greatly widened in the antenna 110.

The radiation characteristics in the x-y plane shown in FIG. 11(*c*) are the result of a simulation at the low-order resonance frequency of 0.85 GHz. The radiation characteristics in the x-y plane shown in FIG. 11(*d*) are the result of a simulation at the high-order resonance frequency of 1.80 GHz. The radiation characteristics are represented in the polar coordinates shown in FIG. 3. At the low-order resonance frequency of 0.85 GHz, the directionality in the entire structure and θ-direction is as indicated by a radiation pattern 131*a*, and the directionality in the ϕ-direction is as indicated by a radiation pattern 131*b*. At high-order resonance frequency of 1.80 GHz, the directionality in the entire structure and θ-direction is as indicated by a radiation pattern 131*c*, and the directionality in the ϕ-direction is as indicated by a radiation pattern 131*d*. As can be seen from FIG. 11(*c*) and FIG. 11(*d*), excellent omnidirectionality is achieved at either resonance frequency. The radiation patterns 131*a*, 131*b*, 131*c*, and 131*d* are substantially the same as the radiation patterns 126*a*, 126*b*, 126*c*, and 126*d* of the antenna 105 shown in FIG. 6.

Eleventh Embodiment

Figure 12:
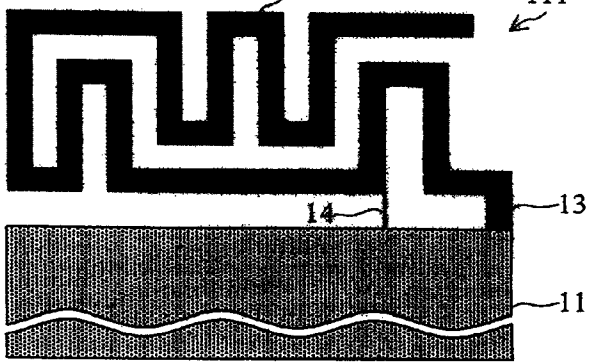
FIG. 12 shows an example of an antenna according to an eleventh embodiment.
Figure 12:
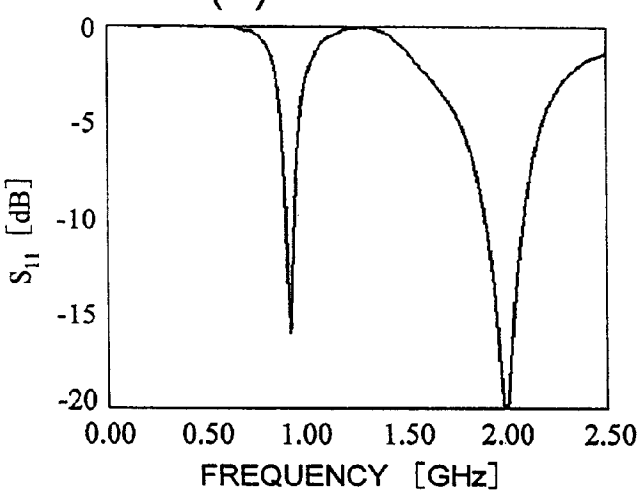
Figure 12:
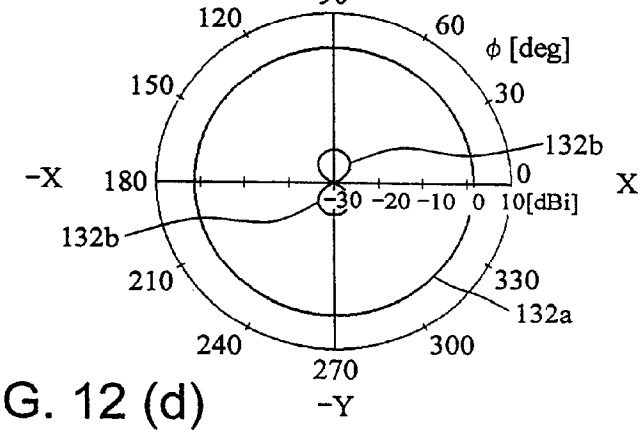
Figure 12:
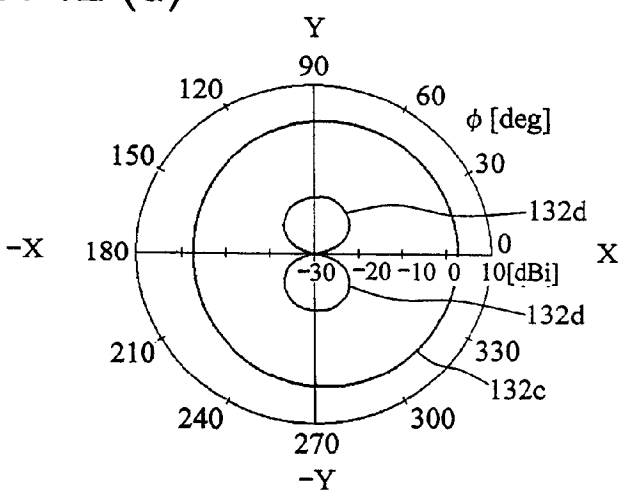

FIG. 12 shows an example of an antenna according to this embodiment: FIG. 12(*a*) shows the structure of the antenna; FIG. 12(*b*) shows the input characteristics of the antenna; and FIG. 12(*c*) and FIG. 12(*d*) show the radiation characteristics in the x-y plane. In the antenna 111, the lower arm has one meandered portion, the upper arm has two meandered portions, and the shorting pin 13 has one meandered portion, with the findings in the second through the tenth embodiments being applied to this embodiment.

The input characteristics of an antenna shown in FIG. 12(*b*) are the result of a simulation of the input characteristics of the antenna 111, and are represented by the absolute values of the scattering parameter $S_{11}$. The first resonance frequency band that satisfies $|S_{11}| \leqq -5$ dB is the band from 0.88 GHz to 0.96 GHz, and the second resonance frequency band is the band from 1.75 GHz to 2.18 GHz. The first resonance frequency band and the second resonance frequency band cover GSM, PCS, and UMTS.

The radiation characteristics in the x-y plane shown in FIG. 12(*c*) are the result of a simulation at the low-order resonance frequency of 0.92 GHz. The radiation characteristics in the x-y plane shown in FIG. 12(*d*) are the result of a simulation at the high-order resonance frequency of 1.94 GHz. The radiation characteristics are represented in the polar coordinates shown in FIG. 3. At the low-order resonance frequency of 0.92 GHz, the directionality in the entire structure and θ-direction is as indicated by a radiation pattern 132*a*, and the directionality in the ϕ-direction is as indicated by a radiation pattern 132*b*. At high-order resonance frequency of 1.94 GHz, the directionality in the entire structure and θ-direction is as indicated by a radiation pattern 132*c*, and the directionality in the ϕ-direction is as indicated by a radiation pattern 132*d*. As can be seen from FIG. 12(*c*) and FIG. 12(*d*), excellent omnidirectionality is achieved at either resonance frequency.

Twelfth Embodiment

Figure 13:
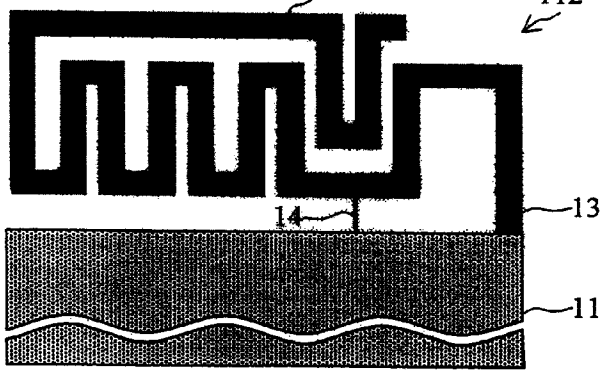
FIG. 13 shows an example of an antenna according to a twelfth embodiment.
Figure 13:
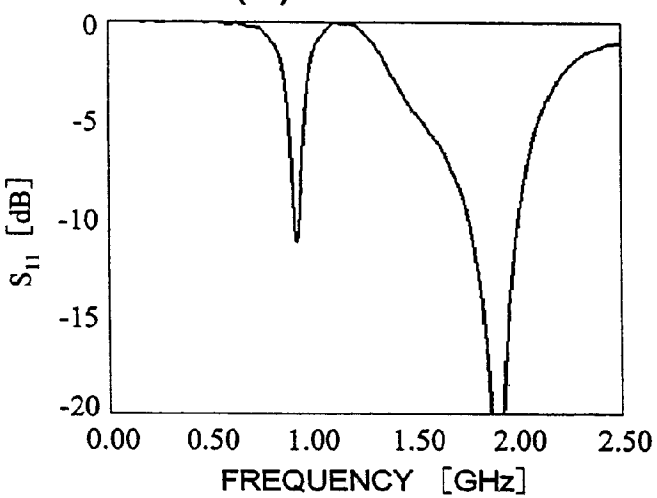
Figure 13:
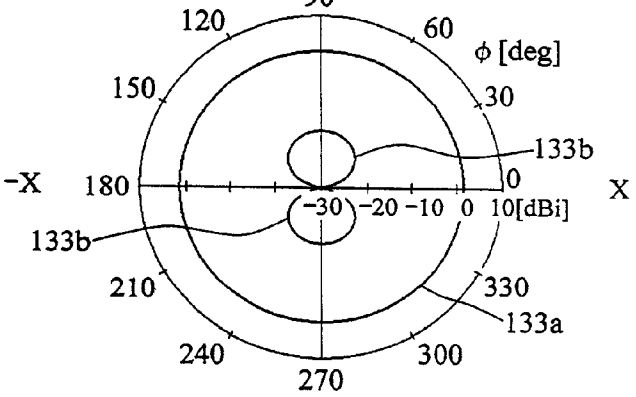
Figure 13:
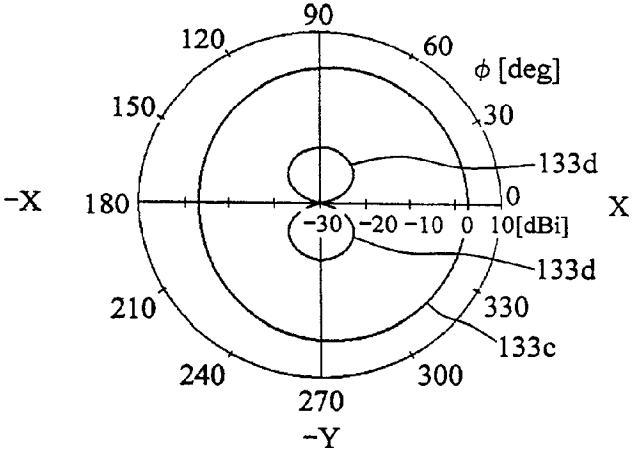

FIG. 13 shows an example of an antenna according to this embodiment: FIG. 13(*a*) shows the structure of the antenna; FIG. 13(*b*) shows the input characteristics of the antenna; and FIG. 13(*c*) and FIG. 13(*d*) show the radiation characteristics in the x-y plane. In the antenna 112, the lower arm has three meandered portions, the upper arm has one meandered portion, and the shorting pin 13D has one meandered portion, with the findings in the second through the tenth embodiments being applied to this embodiment.

The input characteristics of an antenna shown in FIG. 13(*b*) are the result of a simulation of the input characteristics of the antenna 112, and are represented by the absolute values of the scattering parameter $S_{11}$. The first resonance frequency band that satisfies $|S_{11}| \leqq -5$ dB is the band from 0.88 GHz to 0.96 GHz, and the second resonance frequency band is the band from 1.55 GHz to 2.12 GHz. The first resonance frequency band and the second resonance frequency band cover GSM, DCS, and PCS.

The radiation characteristics in the x-y plane shown in FIG. 13(*c*) are the result of a simulation at the low-order resonance frequency of 0.92 GHz. The radiation characteristics in the x-y plane shown in FIG. 13(*d*) are the result of a simulation at the high-order resonance frequency of 1.94 GHz. The radiation characteristics are represented in the polar coordinates shown in FIG. 3. At the low-order resonance frequency of 0.92 GHz, the directionality in the entire structure and θ-direction is as indicated by a radiation pattern 133*a*, and the directionality in the ϕ-direction is as indicated by a radiation pattern 133*b*. At high-order resonance frequency of 1.94 GHz, the directionality in the entire structure and θ-direction is as indicated by a radiation pattern 133*c*, and the directionality in the ϕ-direction is as indicated by a radiation pattern 133*d*. As can be seen from FIG. 13(*c*) and FIG. 13(*d*), excellent omnidirectionality is achieved at either resonance frequency.

Thirteenth Embodiment

Antenna structures according to the present invention are not limited to those of the first through the twelfth embodiments. FIG. 14 shows other examples of antenna structures. The antenna 113 shown in FIG. 14(*a*) is the same as the antenna 102 of the second embodiment, except that the radiation conductor 12 has a smaller width. The antenna 114 shown in FIG. 14(*c*) is the same as the antenna 102 of the second embodiment, except that the plane of the radiation conductor 12 deviates from the plane of the grounded conductor 11, and the radiation conductor 12 is located in a different plane from the plane of the grounded conductor 11. The antenna 115 shown in FIG. 14(*b*) is the same as the antenna 102 of the second embodiment, except that the radiation conductor 12 is perpendicular to the grounded conductor 11, and is placed in a different plane from the plane of the grounded conductor 11. Further, the radiation conductor 12 is placed inside the grounded conductor 11. The antenna 116 shown in FIG. 14(*d*) is the same as the antenna 107 of the seventh embodiment, except that the bent width in the x-y plane is smaller. Each of the antennas 113, 114, 115, and 116 has substantially the same input characteristics and directionality as the antenna 102 of the second embodiment.

Fourteenth Embodiment

Figure 15:
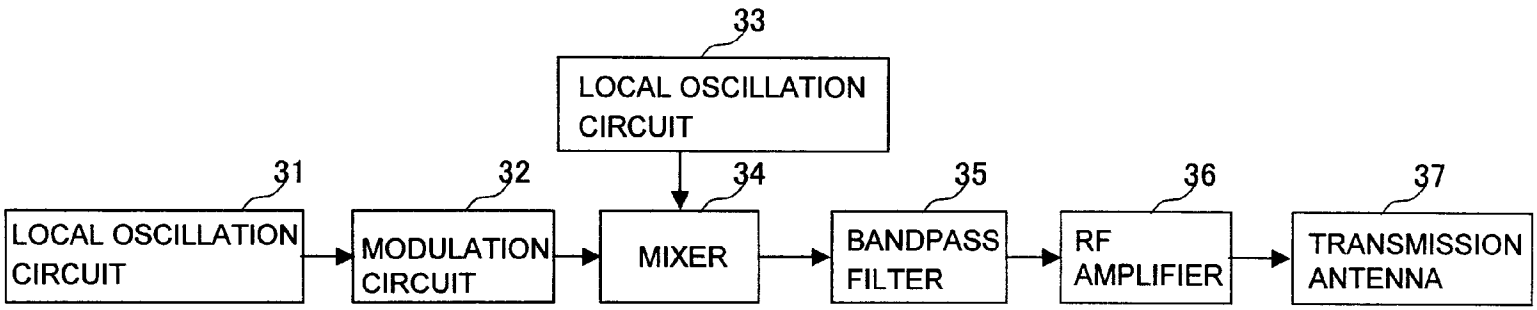
FIG. 15 is a schematic view of a wireless communication device according to a fourteenth embodiment.
Figure 15:
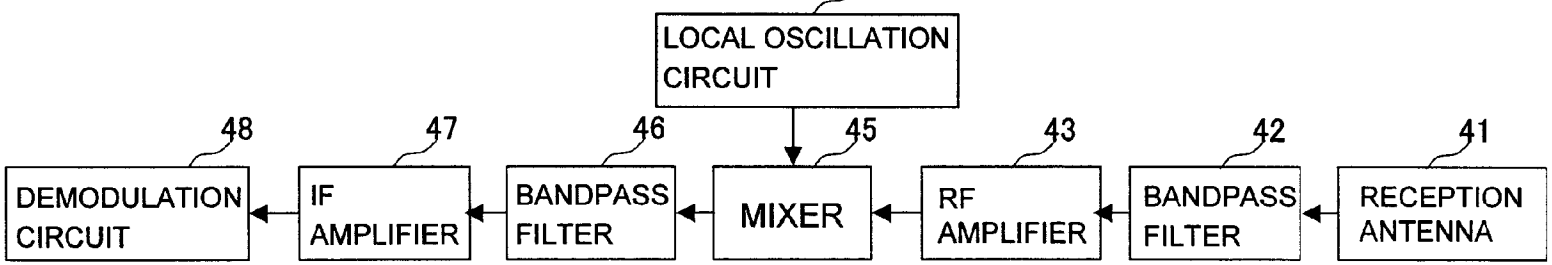

FIG. 15 is a schematic view of a wireless communication device according to this embodiment: FIG. 15(*a*) shows an example of a transmission device; and FIG. 15(*b*) shows an example of a reception device. The transmission device shown in FIG. 15(*a*) includes a transmission antenna 37. The transmission device shown in FIG. 15(*b*) equipped with a reception antenna 41. Having the transmission device and reception device, the wireless communication device may be a transmission and reception device such as a mobile phone handset. In this case, the transmission antenna 37 and the reception antenna 41 can share one antenna to be a shared antenna. In the wireless communication device according to this embodiment, the transmission antenna 37 or the reception antenna 41 is formed with the antenna according to one of the first through the thirteenth embodiments. With this arrangement, the wireless communication device can be small in size, have such input characteristics as to secure consistency in each band, and maintain omnidirectionality.

An example structure and functions of the transmission device shown in FIG. 15(*a*) are described. A local oscillation circuit 31 generates carries of 130 MHz in frequency. A modulation circuit 32 modulates the carries generated from the local oscillation circuit 31, in accordance with input data. A local oscillation circuit 33 generates carrier waves at 1.8 GHz in frequency. A mixer 34 frequency-transforms the signals output from the modulation circuit 32 at the oscillating frequency of 1.8 GHz of the local oscillation circuit 33. A bandpass filter 35 removes noise from the RF signals output from the mixer 34, and a RF amplifier 36 amplifies the signals output from the bandpass filter 35. The transmission antenna 37 transmits the signals output from the RF amplifier 36 as radio signals. Having the above structure and functions, the wireless communication device according to this embodiment can transmit radio signals.

In a case where the antenna according to one of the first through the thirteenth embodiments is used as the transmission antenna 37, the frequencies generated by the local oscillation circuit 33 can cover not only DCS including 1.8 GHz, but also the frequencies used in multibands such as GSM, PCS, and UMTS. Thus, radio signals of frequencies corresponding to frequency multibands can be transmitted.

An example structure and functions of the reception device shown in FIG. 15(*b*) are now described. The reception antenna 41 receives radio signals. A bandpass filter 42 removes noise from the signals output from the reception antenna 41. A RF amplifier 43 amplifies the signals output from the bandpass filter 42. A local oscillation circuit 44 generates carrier waves at the frequency of 1.8 GHz. A mixer 45 performs a frequency transform on the signals output from the RF amplifier 43 at the oscillation frequency of 1.8 GHz of the local oscillation circuit 44. A bandpass filter 46 removes noise from the signals output from the mixer 45. An IF amplifier 47 amplifies the signals output from the bandpass filter 46. A demodulation circuit 48 demodulates the signals output from the IF amplifier 47. Having the above structure and functions, the wireless communication device according to this embodiment can receive radio signals.

In a case where the antenna according to one of the first through the thirteenth embodiments is used as the reception antenna 41, the frequencies generated by the local oscillation circuit 44 can cover not only DCS including 1.8 GHz, but also the frequencies used in multibands such as GSM, PCS, and UMTS. Thus, radio signals of frequencies corresponding to frequency multibands can be transmitted.

Example 1

Figure 16:
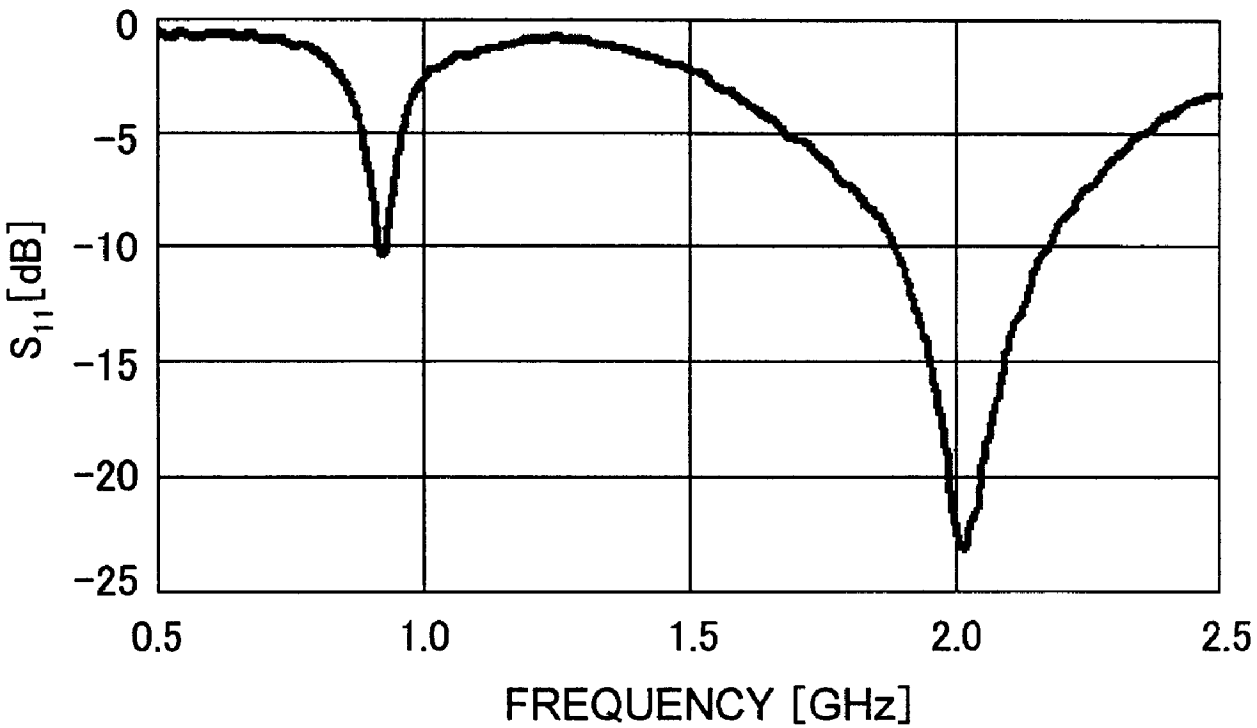
FIG. 16 shows the values of the input characteristics of the antenna actually measured in the first embodiment.

The antenna described in the eleventh embodiment was manufactured, and the input characteristics were measured. The antenna was formed with a metal wire made of copper. The diameter of the metal wire was 1.3 mm. FIG. 16 shows the values of the actually measured input characteristics of the antenna according to Example 1. As in FIG. 12(*b*), the input characteristics are represented by the absolute values of the scattering parameter $S_{11}$. The first resonance frequency band that satisfies $|S_{11}| \leqq -5$ dB is the band from 0.88 GHz to 0.96 GHz, and the second resonance frequency band is the band from 1.69 GHz to 2.35 GHz. The first resonance frequency band and the second resonance frequency band cover GSM, DCS, PCS, and UMTS. The same results were also obtained with a metal film made of copper. Since the values obtained through the actual measurement show excellent consistency with the corresponding simulation results, it is apparent that the other simulation results also have high reliability.

Example 2

Figure 17:
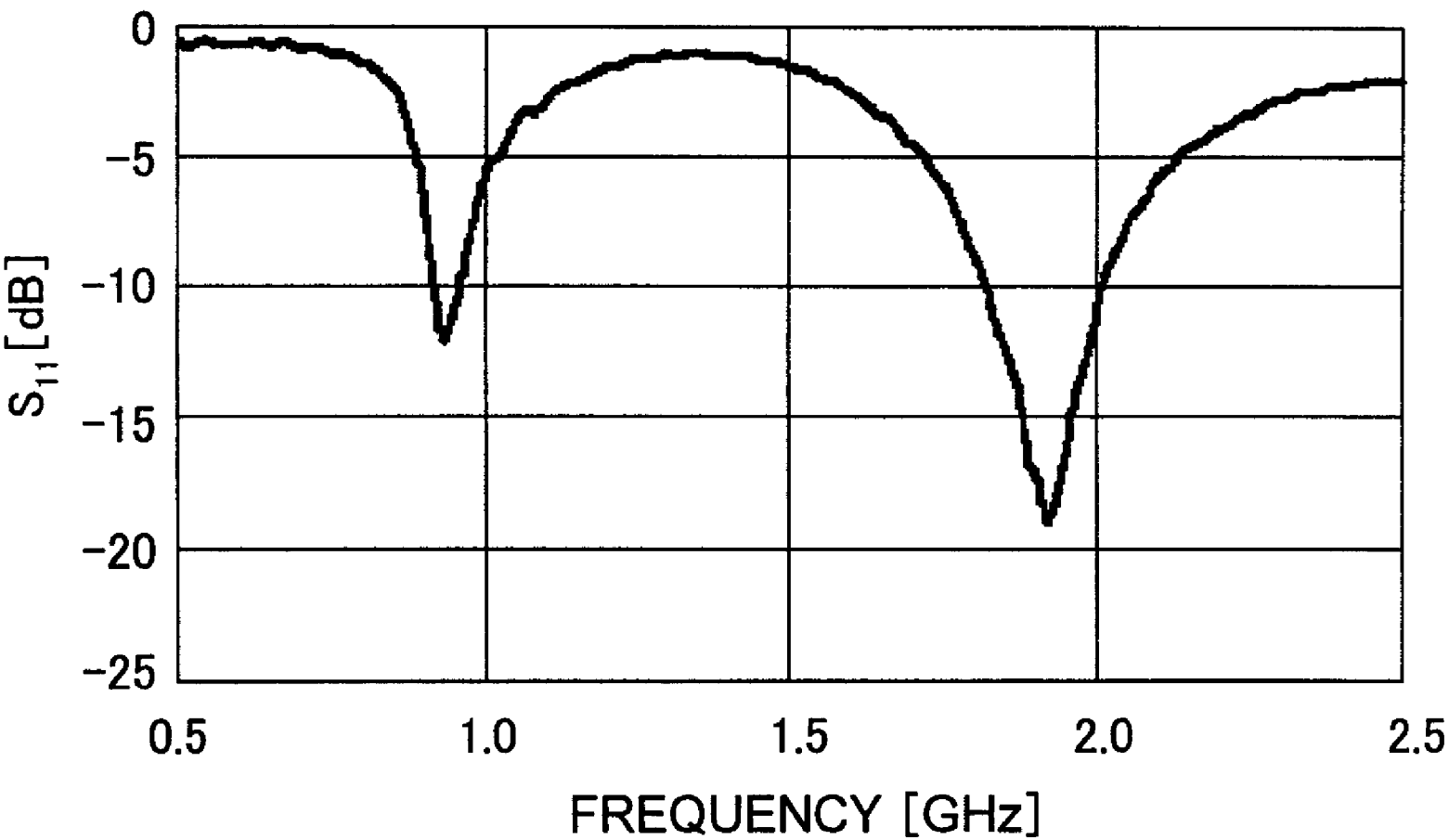
FIG. 17 shows the values of the input characteristics of the antenna actually measured in the second embodiment.

The antenna described in the twelfth embodiment was manufactured, and the input characteristics were measured. The antenna was formed with a metal wire made of copper. The diameter of the metal wire was 1.3 mm. FIG. 17 shows the values of the actually measured input characteristics of the antenna according to Example 2. As in FIG. 12(*b*), the input characteristics are represented by the absolute values of the scattering parameter $S_{11}$. The first resonance frequency band that satisfies $|S_{11}| \leqq -5$ dB is the band from 0.88 GHz to 1.02 GHz, and the second resonance frequency band is the band from 1.70 GHz to 2.18 GHz. The first resonance frequency band and the second resonance frequency band cover GSM, DCS, PCS, and UMTS. The same results were also obtained with a metal film made of copper. Since the values obtained through the actual measurement show excellent consistency with the corresponding simulation results, it is apparent that the other simulation results also have high reliability.

INDUSTRIAL APPLICABILITY

The present invention provides an antenna that is mounted on an information terminal such as a mobile phone handset, a PDA, or a notebook PC, and enables efficient transmission and reception of radio signals in mobile phone multibands such as the GSM band from 880 MHz to 960 MHz, the DCS band from 1710 MHz to 1880 MHz, the PCS band from 1850 MHz to 1990 MHz, and the UMTS band from 1920 MHz to 2170 MHz.

The invention claimed is:

1. An antenna comprising:

a grounded conductor;

a shorting pin that is formed with a conductor; and a radiation conductor that has one end connected to the grounded conductor via the shorting pin, has the other end left open, and receives power supplied from a feeding point located at the one end, wherein the radiation conductor is folded at a portion between the one end and the other end, forming a first arm and a second arm being folded, the first arm is closer to the grounded conductor than the second arm, and the first arm includes a first meandered portion, the second arm includes a second meandered portion and the shorting pin include[s] a third meandered portion.

2. The antenna according to claim 1, wherein the radiation conductor and the shorting pin are formed with one continuous conductor line.

3. The antenna according to claim 1, wherein the radiation conductor is placed in the same plane as the grounded conductor.

4. The antenna according to claim 1, wherein the radiation conductor is placed in a different plane from the grounded conductor.

5. The antenna according to claim 4, wherein the radiation conductor or the shorting pin is folded at least once along a straight line that runs parallel to a extending direction of the first arm or the second arm.

6. The antenna according to claim 5, wherein the radiation conductor is fixed to a dielectric material.

7. A wireless communication device comprising the antenna according to claim 1.

* * * * *